US010308034B2

(12) United States Patent
Usui et al.

(10) Patent No.: US 10,308,034 B2
(45) Date of Patent: Jun. 4, 2019

(54) LIQUID CONTAINER, LIQUID REMAINING AMOUNT DETECTION CIRCUIT OF LIQUID CONTAINER, LIQUID REMAINING AMOUNT DETECTION METHOD, LIQUID CONTAINER IDENTIFICATION METHOD, INK MOUNTING UNIT, PRINTER, AND PRINT SYSTEM

(71) Applicant: ROHM CO., LTD., Ukyo-ku, Kyoto (JP)

(72) Inventors: Hirotoshi Usui, Kyoto (JP); Yukihiro Iwamoto, Kyoto (JP); Masaya Hirakawa, Kyoto (JP); Masao Nakajima, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/485,865

(22) Filed: Apr. 12, 2017

(65) Prior Publication Data

US 2017/0297345 A1 Oct. 19, 2017

(30) Foreign Application Priority Data

Apr. 15, 2016 (JP) ..... 2016-081816

(51) Int. Cl.
*B41J 2/175* (2006.01)

(52) U.S. Cl.
CPC ..... *B41J 2/17566* (2013.01); *B41J 2/17513* (2013.01); *B41J 2/17546* (2013.01); *B41J 2002/17579* (2013.01)

(58) Field of Classification Search
CPC . B41J 2/17566; B41J 2/17513; B41J 2/17546
See application file for complete search history.

(56) References Cited

U.S. PATENT DOCUMENTS

| | | | | |
|---|---|---|---|---|
| 6,106,111 | A * | 8/2000 | Taneya | B41J 2/14048 347/65 |
| 2002/0126164 | A1* | 9/2002 | Walker | B41J 2/17509 347/7 |
| 2013/0050359 | A1* | 2/2013 | Kanbe | B41J 2/175 347/86 |
| 2013/0074595 | A1* | 3/2013 | Muyskens | G01F 23/0076 73/304 C |

FOREIGN PATENT DOCUMENTS

| | | | |
|---|---|---|---|
| JP | 07007100 | A | 1/1995 |
| JP | 08064759 | A | 3/1996 |
| JP | 2005183463 | A | 7/2005 |
| JP | 2012209470 | A | 10/2012 |
| JP | 2013004766 | A | 1/2013 |
| JP | 2015156466 | A | 8/2015 |

* cited by examiner

*Primary Examiner* — Jason S Uhlenhake
(74) *Attorney, Agent, or Firm* — Cantor Colburn LLP

(57) ABSTRACT

A liquid container for accommodating a liquid includes: a plurality of detection electrodes mounted on the liquid container and connected to a detection circuit installed outside the liquid container, wherein the plurality of detection electrodes detects a tilt of the liquid container.

9 Claims, 26 Drawing Sheets

| Number of electrodes | Hypotenuse (cm) | Angle |
|---|---|---|
| 6 | 12 | 3.97 |
| 5 | 10 | 5.71 |
| 4 | 8 | 8.88 |
| 3 | 6 | 15.52 |
| 2 | 4 | 32.01 |
| 1 | 2 | 68.20 |

FIG. 10A
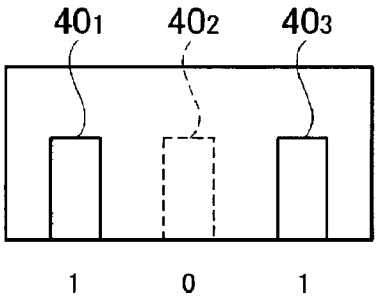
FIG. 10B
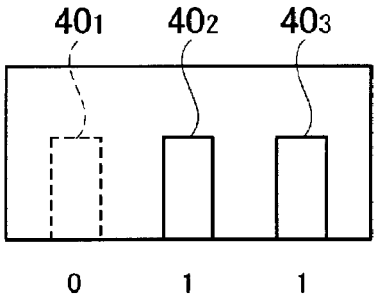
FIG. 10C
| Pattern | Electrode 1 | Electrode 2 | Electrode 3 |
|---|---|---|---|
| Pattern 1 | 1 | 1 | 1 |
| Pattern 2 | 1 | 1 | 0 |
| Pattern 3 | 1 | 0 | 1 |
| Pattern 4 | 1 | 0 | 0 |
| Pattern 5 | 0 | 1 | 1 |
| Pattern 6 | 0 | 1 | 0 |
| Pattern 7 | 0 | 0 | 1 |
| Pattern 8 | 0 | 0 | 0 |
FIG. 10D
| Pattern | Electrode 1 | Electrode 2 |
|---|---|---|
| Pattern 1 | 1 | 1 |
| Pattern 2 | 1 | 0 |
| Pattern 3 | 0 | 1 |
| Pattern 4 | 0 | 0 |

LIQUID CONTAINER, LIQUID REMAINING AMOUNT DETECTION CIRCUIT OF LIQUID CONTAINER, LIQUID REMAINING AMOUNT DETECTION METHOD, LIQUID CONTAINER IDENTIFICATION METHOD, INK MOUNTING UNIT, PRINTER, AND PRINT SYSTEM

CROSS-REFERENCE TO RELATED APPLICATION(S)

This application is based upon and claims the benefit of priority from Japanese Patent Application No. 2016-081816, filed on Apr. 15, 2016, the entire contents of which are incorporated herein by reference.

TECHNICAL FIELD

The present disclosure relates to a liquid container, a liquid remaining amount detection circuit of the liquid container, a liquid remaining amount detection method, a liquid container identification method, an ink mounting unit, a printer, and a print system.

BACKGROUND

There have been proposed various mechanisms for detecting and managing the remaining amount of ink in an ink cartridge containing an ink used in ink jet printers and the like.

A method of detecting the ink remaining amount may include, for example, a dot count method, an optical method, and the like.

The dot count method is a method of estimating an approximate ink remaining amount by counting an amount of ink consumed for printing, nozzle cleaning, and the like. This method has a function of warning by displaying on a display of a printer main body or by sounding a buzzer, when the ink remaining amount becomes small.

The optical method is a method of detecting presence or absence of ink by reflection of light which is contacted on a visible ink through a prism part obtained by partially machining a bottom of an ink cartridge into a prism shape.

There has also been proposed an ink cartridge having an IC chip or the like provided with an ink remaining amount detection function.

In order to detect the ink remaining amount in an ink cartridge, it is necessary to stabilize a level of ink in the ink cartridge. For example, when a printer or the like having an ink cartridge mounted thereon is installed in a tilted state, the remaining ink amount in the ink cartridge cannot be accurately detected. In particular, in the case of detecting a remaining amount of fuel in a fuel tank of a car or the like, when the car is traveling or stopped on a non-flat road surface, it is difficult to accurately detect the remaining amount of fuel in the fuel tank.

In addition, in the case of detecting a remaining amount of liquid such as an ink or a fuel, when a liquid container and its content is predetermined, it is possible to detect the remaining amount of the liquid by comparing a preset detection reference capacitance value corresponding to the container and the content with a level of the liquid. In this case, it is necessary to prepare a dedicated IC and a memory for storing the detection reference capacitance value and enabling it to be read out when necessary. However, if an IC or the like is prepared for each product, for example, for each ink cartridge, this may result in an increase in cost and time required for designing the product.

In addition, in the case of mounting an ink cartridge for color printing on an ink mounting unit or the like of a printer main body, it is necessary to mount ink cartridges prepared for different colors in respective predetermined positions in the ink mounting unit.

SUMMARY

The present disclosure provides some embodiments of a liquid container, a liquid remaining amount detection circuit of the liquid container, a liquid remaining amount detection method, a liquid container identification method, an ink mounting unit, a printer, and a print system, which are capable of detecting a remaining amount of liquid such as ink with high precision with a simple and inexpensive mechanism and identifying a liquid container such as an ink cartridge with a simple and inexpensive mechanism.

According to one embodiment of the present disclosure, there is provided a liquid container for accommodating a liquid, including: a plurality of detection electrodes mounted on the liquid container and connected to a detection circuit installed outside the liquid container. The plurality of detection electrodes detects a tilt of the liquid container.

According to another embodiment of the present disclosure, there is provided a detection circuit connected to a plurality of detection electrodes mounted on a liquid container, including: a capacitor having a reference capacitance; a capacitance/voltage conversion circuit configured to determine a voltage value corresponding to a level of a liquid in the liquid container by comparing capacitances detected by the plurality of detection electrodes with the reference capacitance; an analog/digital converter connected to an output of the capacitance/voltage conversion circuit and configured to convert the voltage value into a digital signal: and a microcontroller unit connected to an output of the analog/digital converter and configured to receive the digital signal as a value of the level of the liquid. The detection circuit detects a degree of tilt of the liquid container based on the capacitance detected by the plurality of detection electrodes, and detects a remaining amount of the liquid in the liquid container according to the detected degree of tilt.

According to another embodiment of the present disclosure, there is provided an ink mounting unit that mounts the above-described liquid container as an ink cartridge.

According to another embodiment of the present disclosure, there is provided a printer including: one or more above-described ink mounting units; one or more above-described detection circuits, each of which is connected to the plurality of detection electrodes installed in corresponding one of the one or more ink cartridges; and a printer main body control part configured to output a warning message or a warning sound to an output part in response to a remaining amount information of the liquid and an identification information of the liquid container transmitted from the one or more ink mounting units.

According to another embodiment of the present disclosure, there is provided a print system including: the above-described printer; and an external control device connected to the printer directly or via a network. The printer outputs the warning message or the warning sound to the external control device in response to the remaining amount information of the liquid and the identification information of the liquid container which are transmitted from the one or more ink mounting units.

According to another embodiment of the present disclosure, there is provided a method of detecting the remaining amount of a liquid in a liquid container, which is executed in a detection circuit connected to a plurality of detection electrodes mounted on the liquid container. The method includes: detecting, by the detection circuit, a level of the liquid in the liquid container using the plurality of detection electrodes; determining whether or not there is a difference in values detected using the plurality of detection electrodes; detecting, by the detection circuit, a degree of tilt of the liquid container based on the detected values when there is the difference in the detected values; and detecting, by the detection circuit, the remaining amount of the liquid in the liquid container according to the detected degree of tilt.

According to another embodiment of the present disclosure, there is provided a method of identifying a liquid container, which is executed in a detection circuit connected to a plurality of detection electrodes mounted on the liquid container. The method includes: detecting, by the detection circuit, an arrangement pattern of the plurality of detection electrodes in the liquid container; determining, by the detection circuit, whether or not the detected arrangement pattern matches a predetermined arrangement pattern; and determining, by the detection circuit, that the liquid container is not mounted in a predetermined position if the detected arrangement pattern does not match the predetermined arrangement pattern, and outputting a warning.

According to another embodiment of the present disclosure, there is provided a method of detecting the remaining amount of a liquid in a liquid container, which is executed in a detection circuit connected to a plurality of detection electrodes mounted on the liquid container. The method includes: performing, by the detection circuit, a calibration using the plurality of detection electrodes and setting and storing a reference capacitance value according to a state of the liquid container; detecting, by the detection circuit, a level of the liquid in the liquid container using the plurality of detection electrodes based on the reference capacitance value; determining, by the detection circuit, whether or not there is a difference in values detected using the plurality of detection electrodes; and determining, by the detection circuit, that the level of the liquid is low when there is the difference in the detected values, and outputting a warning.

BRIEF DESCRIPTION OF THE DRAWINGS

FIG. 2A illustrates an example of a liquid container having a plurality of detection electrodes formed on one side surface. FIG. 2B illustrates an example of a liquid container having a detection electrode formed on each of two opposing side surfaces. FIG. 2C illustrates an example of a liquid container having a plurality of detection electrodes formed on each of two opposing side surfaces.

FIG. 3A is a schematic perspective view illustrating a liquid container having a plurality of detection electrodes formed on the bottom surface. FIG. 3B is a schematic perspective view illustrating the liquid container shown in FIG. 3A, which is seen from the bottom. FIG. 3C is a schematic side view showing an example in which the liquid container shown in FIG. 3A is tilted by an angle θ1. FIG. 3D is a schematic side view showing an example in which the liquid container shown in FIG. 3A is tilted by an angle θ2.

FIG. 4A is a schematic perspective view illustrating a liquid container having a plurality of detection electrodes formed on one side surface. FIG. 4B is a schematic side view illustrating the liquid container shown in FIG. 4A, which is seen from the side surface on which the detection electrodes are formed.

FIG. 7A illustrates an example of a liquid container having an identification pattern $\mathbf{50}_1$. FIG. 7B illustrates an example of a liquid container having an identification pattern $\mathbf{50}_2$.

FIG. 8A is a schematic side view showing an example of a liquid container in which the projection engages with a projection shape formed on a mounting part. FIG. 8B is a schematic side view showing an example of a liquid container in which the projection does not engage with a projection shape formed on a mounting part. FIG. 8C is a schematic perspective view showing an example in which the liquid container shown in FIG. 8A is mounted on the mounting part. FIG. 8D is a schematic perspective view showing an example in which the liquid container shown in FIG. 8B is mounted on the mounting part.

FIG. 9A illustrates an example of a liquid container in which a maximum of three detection electrodes are formed on one side surface. FIG. 9B illustrates an example of the liquid container in which a maximum of two detection electrodes are formed on one side surface.

FIG. 10A shows an example of the maximum of three detection electrodes formed in a liquid container. FIG. 10B shows another example of the maximum of three detection electrodes formed in a liquid container. FIG. 10C is an explanatory view illustrating an arrangement pattern of the maximum of three detection electrodes formed in a liquid container. FIG. 10D is an explanatory view illustrating an arrangement pattern of the maximum of two detection electrodes formed in a liquid container.

FIG. 18A shows an example of a liquid level L51. FIG. 18B shows an example of a liquid level L52.

DETAILED DESCRIPTION

Figure 1A:
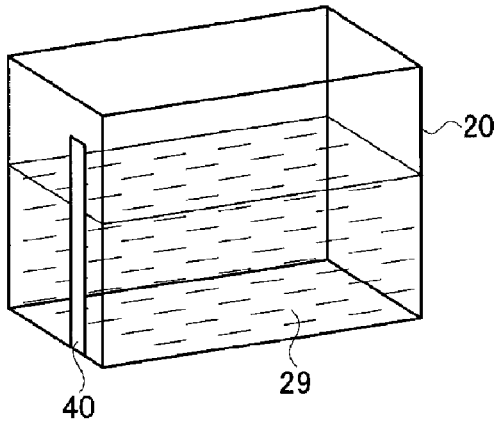
FIG. 1A is a schematic perspective view showing an example of a liquid container having a capacitance type detection electrode.

Embodiments of the present disclosure will now be described in detail with reference to the drawings. Throughout the drawings, the same or similar elements are denoted by the same or similar reference numerals. It is however noted that the drawings are just schematic and relationships between thickness and planar dimension of elements, thickness ratios of various layers and so on may be unrealistic. Accordingly, detailed thickness and dimensions should be determined in consideration of the following description. In addition, it is to be understood that the figures include different dimensional relationships and ratios.

The following embodiments are provided to illustrate devices and methods to embody the technical ideas of the present disclosure and are not limited to materials, forms, structures, arrangements and so on of elements detailed herein. The embodiments of the present disclosure may be modified in different ways without departing from the scope of the present disclosure defined in the claims.

First Embodiment (Example of Liquid Container Having Detection Electrode)

FIG. 1A schematically shows an example of a liquid container 20 having a capacitance type detection electrode 40 according to a first embodiment. As illustrated in FIG. 1A, the liquid container 20 such as an ink cartridge includes one capacitance type detection electrode 40 mounted on one surface (for example, one side surface) of the liquid container 20. The detection electrode 40 is connected to a detection circuit 30 (IC chip) (see FIGS. 19 to 24) installed outside the liquid container 20. The detection electrode 40 is vertically elongated from the vicinity of the bottom of the liquid container 20 (near the height of the minimum level of liquid 29 such as ink) to the vicinity of the top of the liquid container 20 (near the height of the maximum level of the liquid 29). The liquid 29 may include an aqueous solution, mixed water, and the like. The detection electrode 40 may be laid on the outer side or inner side surface of the liquid container 20, or embedded in the outer wall of the liquid container 20. When the detection electrode 40 is laid on the outer side surface of the liquid container 20 or is embedded in the outer wall, the detection electrode 40 may be installed with a predetermined distance (that is to say, a minimum distance required for the detection electrode 40 to detect the existence of the liquid 29, for example, about 1 to 2 mm) from the liquid 29 so as to prevent the detection electrode 40 from making direct contact with the liquid 29.

The detection electrode 40 is an electrode used to detect contact or non-contact of the liquid 29 with the detection electrode 40 (that is to say, presence or absence of the liquid 29) based on a change in capacitance. The detection circuit 30 has a reference value (reference capacitance value) serving as a reference for calibration and compares a capacitance sensed by the detection electrode 40 with the reference capacitance value to detect a level of the liquid 29 (that is to say, a liquid remaining amount) in the liquid container 20. Instead of the capacitance type detection electrode, a pressure-sensitive resistive film type detection electrode may be adopted as the detection electrode 40.

Here, when the liquid container 20 is stably installed as illustrated in FIG. 1A, the level (the height of surface) of the liquid 29 in the liquid container 20 is also stable. Thus, it is possible to detect a change in capacitance by a rate exceeding a sampling (detection) cycle and recognize the detection result as a variation in the level of the liquid 29.

Figure 1B:
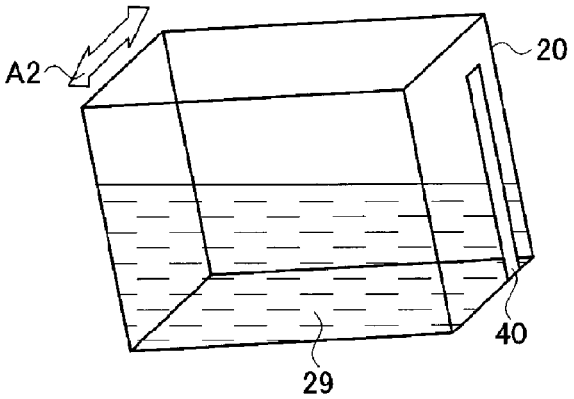
FIG. 1B is a schematic perspective view showing a state in which the liquid container shown in FIG. 1A is tilted in the direction of an arrow A2.
Figure 1C:
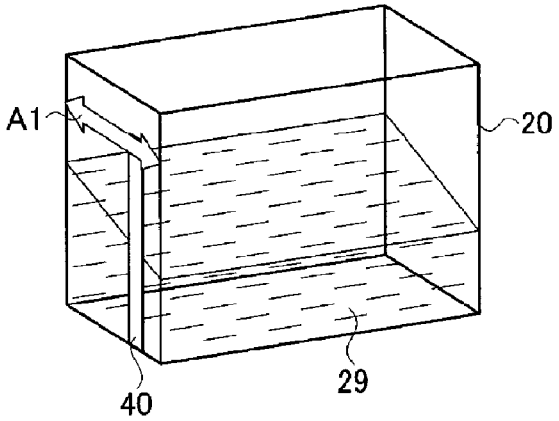
FIG. 1C is a schematic perspective view showing a state in which the liquid container shown in FIG. 1A is tilted in the direction of an arrow A1.

In contrast, in a state where the liquid container 20 is shaken or tilted, for example, when the liquid container 20 is tilted in the direction of an arrow A2 as illustrated in FIG. 1B or when the liquid container 20 is tilted in the direction of an arrow A1 as illustrated in FIG. 1C, the level of the liquid 29 becomes unstable and biased. In this case, it is difficult for the detection electrode 40 to accurately detect the amount (remaining amount) of the liquid 29.

(Configuration Example of Liquid Container Having Detection Electrode for Tilt Detection)

Figure 2A:
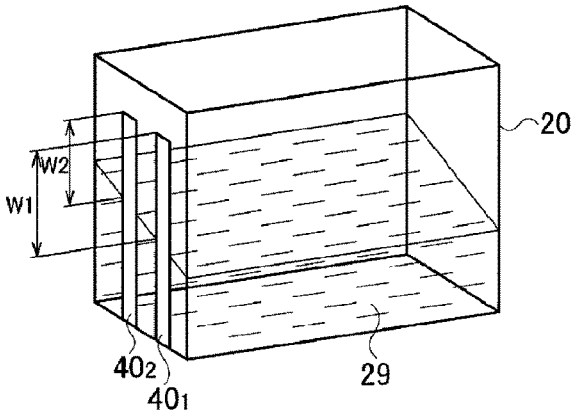
FIGS. 2A to 2C are schematic perspective views illustrating a liquid container according to a first embodiment.
Figure 2B:
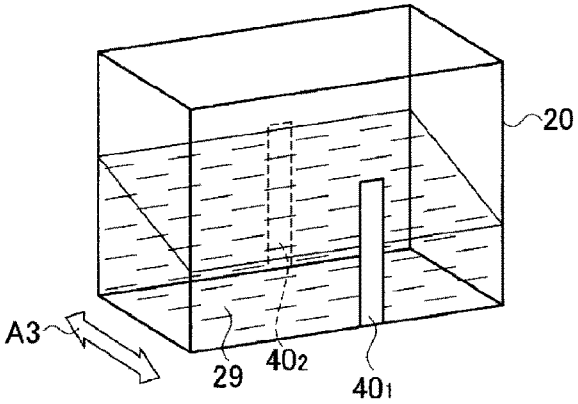
Figure 2C:
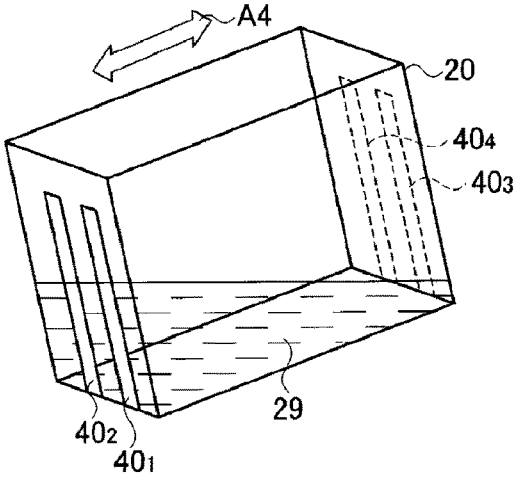

The liquid container 20 according to the first embodiment is schematically illustrated in FIGS. 2A to 2C.

FIG. 2A illustrates a liquid container 20 having a plurality of (two in the illustrated example) detection electrodes $\mathbf{40}_1$ and $\mathbf{40}_2$ installed in one side surface of the liquid container 20 (on the outer side or inner side surface of the liquid container 20 or inside of the outer wall of the liquid container 20). Since the plurality of detection electrodes $40_1$ and $40_2$ is installed in this manner, even when the liquid container 20 is tilted, a degree of tilt (tilt angle) of the liquid container 20 can be detected by detecting a difference between the widths $W_1$ and $W_2$ of non-detection portions in the respective detection electrodes $40_1$ and $40_2$ and the level (remaining amount) of the liquid 29 can be accurately detected in consideration of the degree of tilt of the liquid container 20. As such, the liquid container 20 having a plurality of (two or more) detection electrodes $40_1$ and $40_2$ installed in one side surface of the liquid container 20 can be effectively used to detect a change occurring between the plurality of (two or more) detection electrodes $40_1$ and $40_2$.

FIG. 2B illustrates a liquid container 20 having detection electrodes $40_1$ and $40_2$ installed in two opposing side surfaces of the liquid container 20 (one detection electrode for each of the two opposing side surfaces in the example of FIG. 2B). As illustrated in FIG. 2B, when a change in the level of the liquid 29 is uniform with respect to a wall surface (in the direction of an arrow A3 in the example of FIG. 2B), it is effective to install the detection electrodes $40_1$ and $40_2$ in the two opposing side surfaces of the liquid container 20 as described above.

FIG. 2C illustrates a liquid container 20 having a plurality of detection electrodes $40_1$, $40_2$, $40_3$, and $40_4$ installed in two opposing side surfaces of the liquid container 20 (two detection electrodes for each of the two opposing side surfaces in the example of FIG. 2C). Since the plurality of detection electrodes $40_1$ and $40_2$ and the plurality of detection electrodes $40_3$ and $40_4$ are respectively formed on two opposing side surfaces of the liquid container 20, it is possible to accurately detect the level (remaining amount) of the liquid 29 in response to the direction and degree of tilt of the liquid container 20. For example, it is possible to accurately detect the level (remaining amount) of the liquid 29 in a case where the liquid container 20 is tilted in the direction of the arrow A3 in FIG. 2B, in a case where the liquid container 20 is tilted in the direction of an arrow A4 in FIG. 2C, and the like. In addition, the plurality of detection electrodes 40 installed in the liquid container 20 as illustrated in FIGS. 2A to 2C can be used in common for identification of the liquid container 20. Details of the identification of the liquid container 20 will be described later in a second embodiment.

Figure 3A:
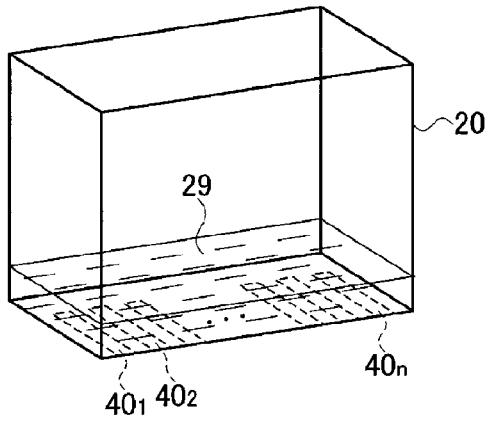
FIGS. 3A to 3D are schematic views illustrating a liquid container according to the first embodiment.
Figure 3B:
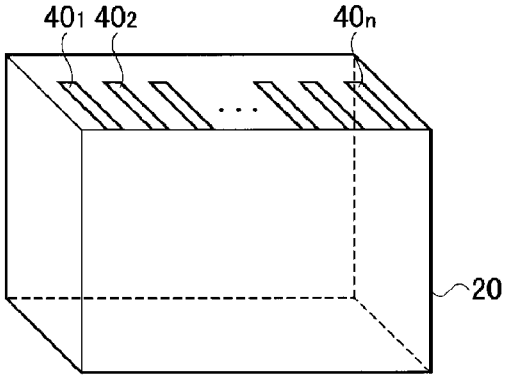
Figure 3C:
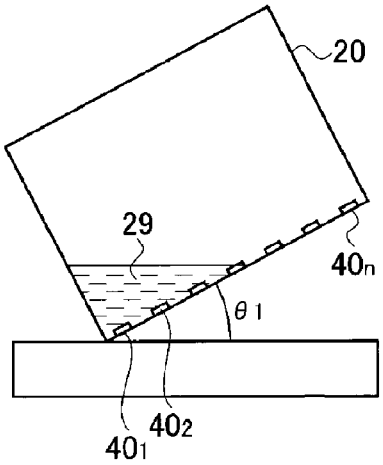
Figure 3D:
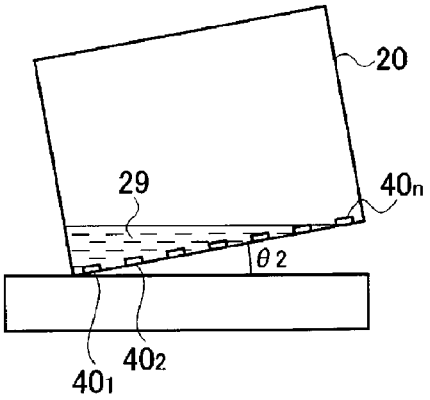
Figure 4A:
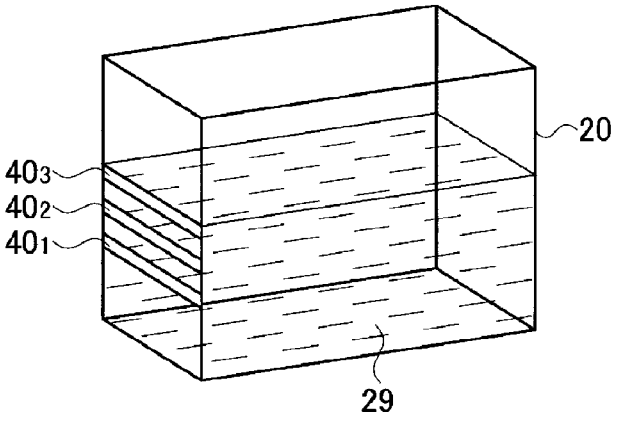
FIGS. 4A and 4B are schematic views illustrating a liquid container according to the first embodiment.
Figure 4B:
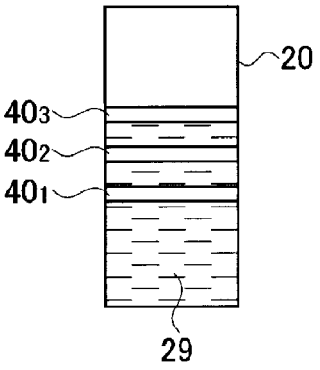

FIGS. 3A to 3D illustrate a liquid container 20 having a plurality of (n) detection electrodes $40_1$, $40_2$, . . . , $40_n$ (n is an integer equal to or greater than 1) installed at predetermined intervals (for example, equal intervals) therebetween in the bottom surface of the liquid container 20 according to the first embodiment. By forming a plurality of (n) detection electrodes $40_1$, $40_2$, . . . , $40_n$ in the bottom surface of the liquid container 20 as illustrated in FIGS. 3A to 3D, even when the amount of shaking or tilt of the liquid container 20 is relatively large (even when the liquid container 20 is significantly shaken or tilted), it is possible to detect the degree of tilt (tilt angle) of the liquid container 20 with higher accuracy. As illustrated in FIGS. 3C and 3D, the degree of tilt (tilt angle) of the liquid container 20 can be detected with high accuracy based on which of the plurality of detection electrodes $40_1$, $40_2$, . . . , $40_n$ installed in the bottom surface of the liquid container 20 detects the presence or absence of the liquid container 20. FIG. 3C shows an example in which the liquid container 20 is tilted by an angle θ1 and FIG. 3D shows an example in which the liquid container 20 is tilted by an angle θ2. As illustrated in FIGS. 4A and 4B, even when a plurality of (three in the example of FIGS. 4A and 4B) detection electrodes $40_1$, $40_2$ and $40_3$ is installed at predetermined intervals (for example, at equal intervals) in one side surface of the liquid container 20, it is possible to detect the degree of tilt (tilt angle) of the liquid container 20 with high accuracy.

Figures 5, 6:
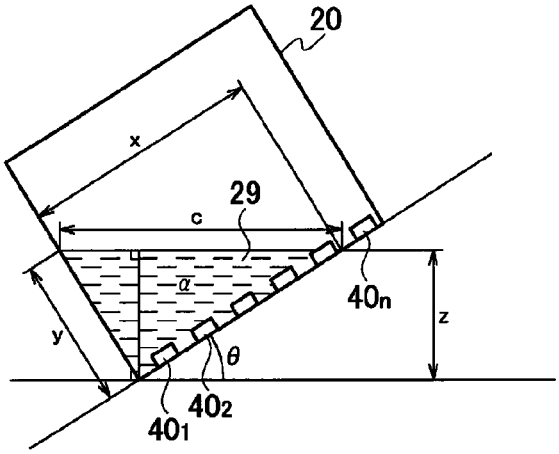
FIG. 5 is a schematic side view showing an example in which a liquid container is tilted by an angle θ.
FIG. 6 is an explanatory view showing an example of a relationship (calculated value) among the number of detection electrodes, a hypotenuse, and an angle in a predetermined area (liquid amount) in the liquid container shown in FIG. 5.

FIG. 5 illustrates an example in which the liquid container 20 according to the first embodiment is tilted by an angle θ. As illustrated in FIG. 5, when an area α (the amount of the liquid 29) is fixed, a right triangle having the area α and sides x, y, and c is formed. Using this right triangle, the area α, the sides x, y, and c, a tilt height z of the liquid container 20, and a tilt angle θ of the liquid container 20 can be obtained from the following equations (1) to (8).

$$\alpha=(x\cdot y)/2 \tag{1}$$

$$y=2a/x \tag{2}$$

$$c=\sqrt{(x^2+y^2)} \tag{3}$$

$$c=\sqrt{(x^2+(2\alpha/x)^2)} \tag{4}$$

$$z=2\alpha/c \tag{5}$$

$$z=2\alpha/\sqrt{(x^2+(2\alpha/x)^2)} \tag{6}$$

$$\theta=\sin^{-1}(2\alpha/(x\cdot\sqrt{(x^2+(2\alpha/x)^2})) \tag{7}$$

$$z=x\sin\theta \tag{8}$$

The calculation accuracy of the tilt angle θ of the liquid container 20 is improved in proportion to the number of detection electrodes $40_1$, $40_2$, . . . , $40_n$ installed in the liquid container 20.

When the detection circuit 30 is equipped in an IC chip, reference values (calculated values) illustrated in FIG. 6 may be prepared in advance and stored in the detection circuit 30 so that they can be read out when necessary. This makes it possible to effectively reduce the circuit scale of the IC chip. FIG. 6 shows an example of a relationship (calculated values) among the number of detection electrodes $40_1$, $40_2$, . . . , $40_n$ that detect the liquid 29 forming a predetermined area α (for example, 5 $cm^2$), a hypotenuse c, and a tilt angle θ in the liquid container 20 illustrated in FIG. 5. For example, when the number of detection electrodes 40 that detected the liquid 29 is six, the hypotenuse c is 12 cm and the tilt angle θ of the liquid container 20 is 3.97 degree. When the number of detection electrodes 40 that detect the liquid 29 is one, the hypotenuse c is 2 cm and the tilt angle θ of the liquid container 20 is 68.20 degree.

As described above, according to the first embodiment, with a simple and inexpensive mechanism in which the detection electrodes 40 ($40_1$, $40_2$, . . . , $40_n$) for tilt detection are installed in the liquid container 20, the tilt of the liquid container 20 can be detected with high accuracy. Further, the detection circuit (IC chip) 30 can detect the level (remaining amount) of the liquid 29 in the liquid container 20 in response to the detected tilt of the liquid container 20 with high accuracy.

Second Embodiment (Identification of Liquid Container)

For example, when an ink cartridge (liquid container) 20 for color printing is mounted on a mounting unit or the like of a printer main body, it is necessary to correctly mount the ink cartridges 20 prepared for different ink colors in respective predetermined positions in the mounting unit. Particularly, in many cases of mounting the ink cartridges 20 for color printing, the ink cartridges 20 being the same in shape and size but different in colors (for example, four colors, six colors, and the like) are arranged adjacent to each other. Even though the ink cartridges 20 have the common role and basic structure, it is necessary to identify the type of each of the ink cartridges 20 according to its contents (color or kind of ink) and mount each of the ink cartridges 20 on a correct mounting part.

Figure 7A:
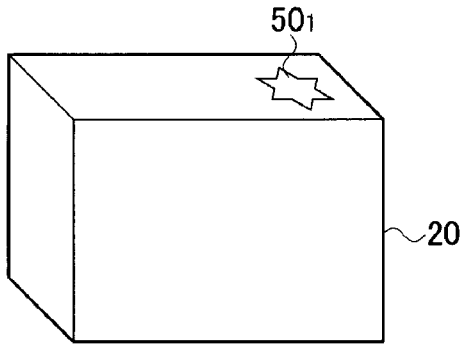
FIGS. 7A and 7B are schematic perspective views illustrating an example of a liquid container having an identification pattern.
Figure 7B:
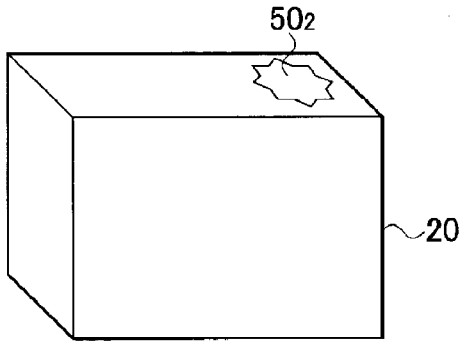

An example of a liquid container 20 having an identification pattern (picture symbol) $\mathbf{50}_1$ or $\mathbf{50}_2$ of the liquid container 20 is schematically illustrated in FIGS. 7A and 7B. For example, the detection circuit (IC chip) 30 reads the identification pattern $\mathbf{50}_1$ or $\mathbf{50}_2$ by means of, for example, a reading sensor (not shown). If the identification pattern $\mathbf{50}_1$ is provided (printed) in the liquid container 20, the detection circuit 30 identifies the container as a yellow ink cartridge 20, for example. If the identification pattern $\mathbf{50}_2$ is provided (printed) in the liquid container 20, the detection circuit 30 identifies the container as a blue ink cartridge 20, for example. As a result, it can be determined whether or not the ink cartridge 20 is mounted on an incorrect portion.

Figure 8A:
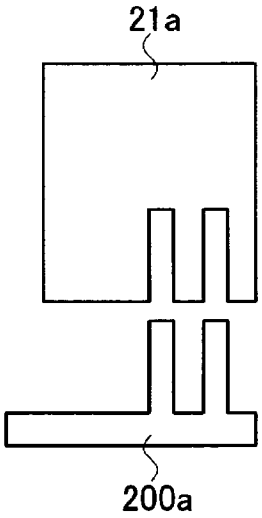
FIGS. 8A to 8D are schematic views illustrating an example of a liquid container having a projection for identifying the liquid container.
Figure 8B:
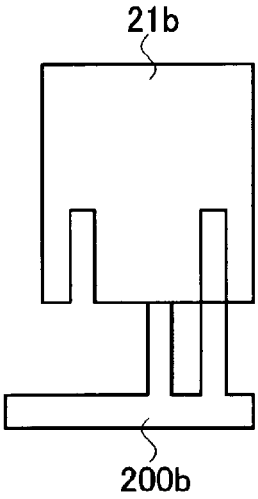
Figure 8C:
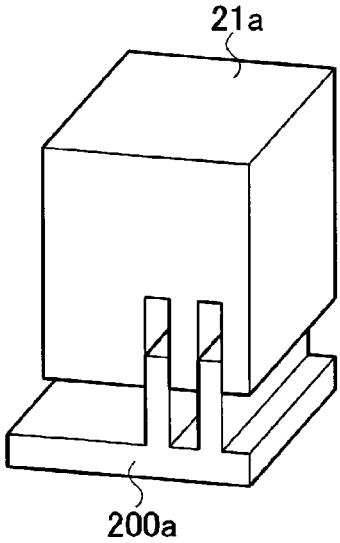
Figure 8D:
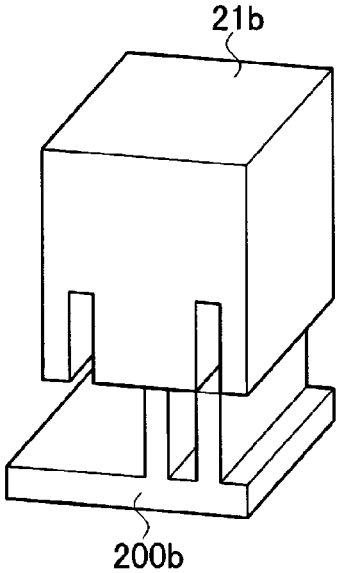

An example of a liquid container 20 having a projection 21*a* or 21*b* for identifying the liquid container 20 is schematically illustrated in FIGS. 8A to 8D. FIG. 8A schematically shows an example of the liquid container 20 provided with the projection 21*a* which engages with the shape of a projection 200*a* formed on a mounting part and FIG. 8B schematically shows an example of the liquid container 20 provided with the projection 200*b* which does not engage with the shape of a projection 200*b* formed on a mounting part. As illustrated in FIG. 8C, the liquid container 20 having the projection 21*a* can be mounted on the mounting part because the projection 21*a* engages with the shape of the projection 200*a*, but as illustrated in FIG. 8D, the liquid container 20 having the projection 20*b* cannot be mounted on the mounting part because the projection 20*b* does not engage with the shape of the projection 200*b*. Thus, it is possible to mount the ink cartridge 20 in a correct place.

(Configuration Example of Liquid Container Having Detection Electrode for Container Identification)

Figure 9A:
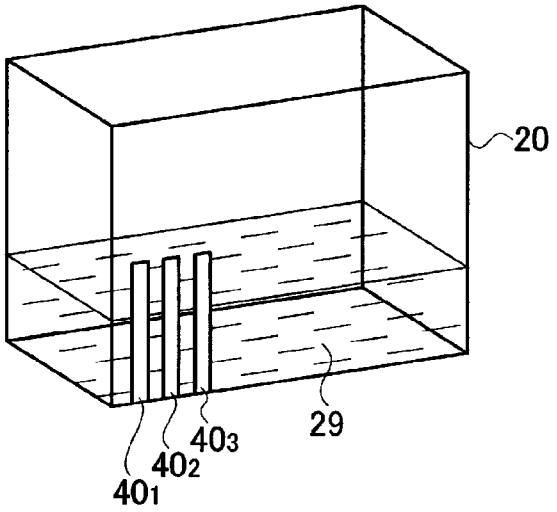
FIGS. 9A and 9B are schematic perspective views illustrating a liquid container according to a second embodiment.
Figure 9B:
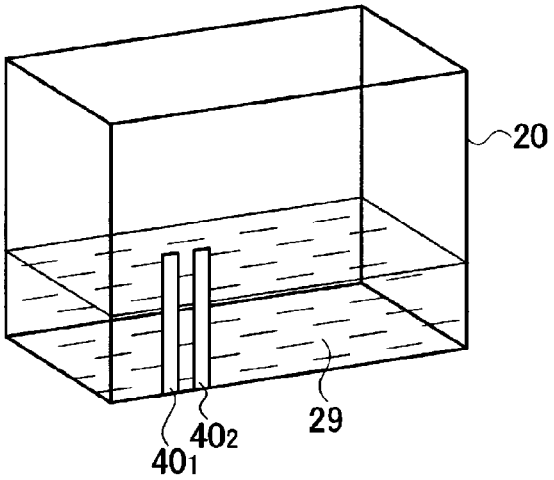

FIGS. 9A and 9B schematically illustrate examples of a liquid container 20 using the detection electrodes 40 ($\mathbf{40}_1$, $\mathbf{40}_2$, . . . , $\mathbf{40}_n$) in common for tilt detection as in the first embodiment and for container identification. FIG. 9A shows an example of the liquid container 20 having the maximum of three detection electrodes $\mathbf{40}_1$, $\mathbf{40}_2$ and $\mathbf{40}_3$ installed in one side surface of the liquid container 20, and FIG. 9B shows an example of the liquid container 20 having the maximum of two detection electrodes $\mathbf{40}_1$ and $\mathbf{40}_2$ installed in one side surface of the liquid container 20. FIGS. 10A to 10D shows various examples of the detection electrodes 40 ($\mathbf{40}_1$, $\mathbf{40}_2$, . . . , $\mathbf{40}_n$) for container identification.

For example, for the liquid container 20 in which up to three detection electrodes $\mathbf{40}_1$, $\mathbf{40}_2$ and $\mathbf{40}_3$ can be installed, there may be an arrangement pattern illustrated in FIG. 10A in which two detection electrodes $\mathbf{40}_1$ and $\mathbf{40}_3$ are installed but the detection electrode $\mathbf{40}_2$ is not installed in the liquid container 20. In addition, there may be an arrangement pattern illustrated in FIG. 10B in which two detection electrodes $\mathbf{40}_2$ and $\mathbf{40}_3$ are installed but the detection electrode $\mathbf{40}_1$ is not installed in the liquid container 20. As such, using the combination of arrangement patterns of the detection electrodes $\mathbf{40}_1$, $\mathbf{40}_2$, and $\mathbf{40}_3$, as illustrated in FIG. 10C, it is possible to identify liquid containers 20 of eight types which are exponential multiples of 2.

Further, as illustrated in FIG. 10D, for the liquid container 20 in which up to two detection electrodes $\mathbf{40}_1$ and $\mathbf{40}_2$ can be formed, liquid containers 20 of four types which are exponential multiples of 2 can be identified. The arrangement pattern 8 "000" illustrated in FIG. 10C and the arrangement pattern 4 "00" illustrated in FIG. 10D can be applied to a case where the detection electrodes 40 are used for detection of level and tilt of the liquid 29 (the first embodiment) but does not used for identification of the liquid container 20 (the second embodiment).

Figure 11:
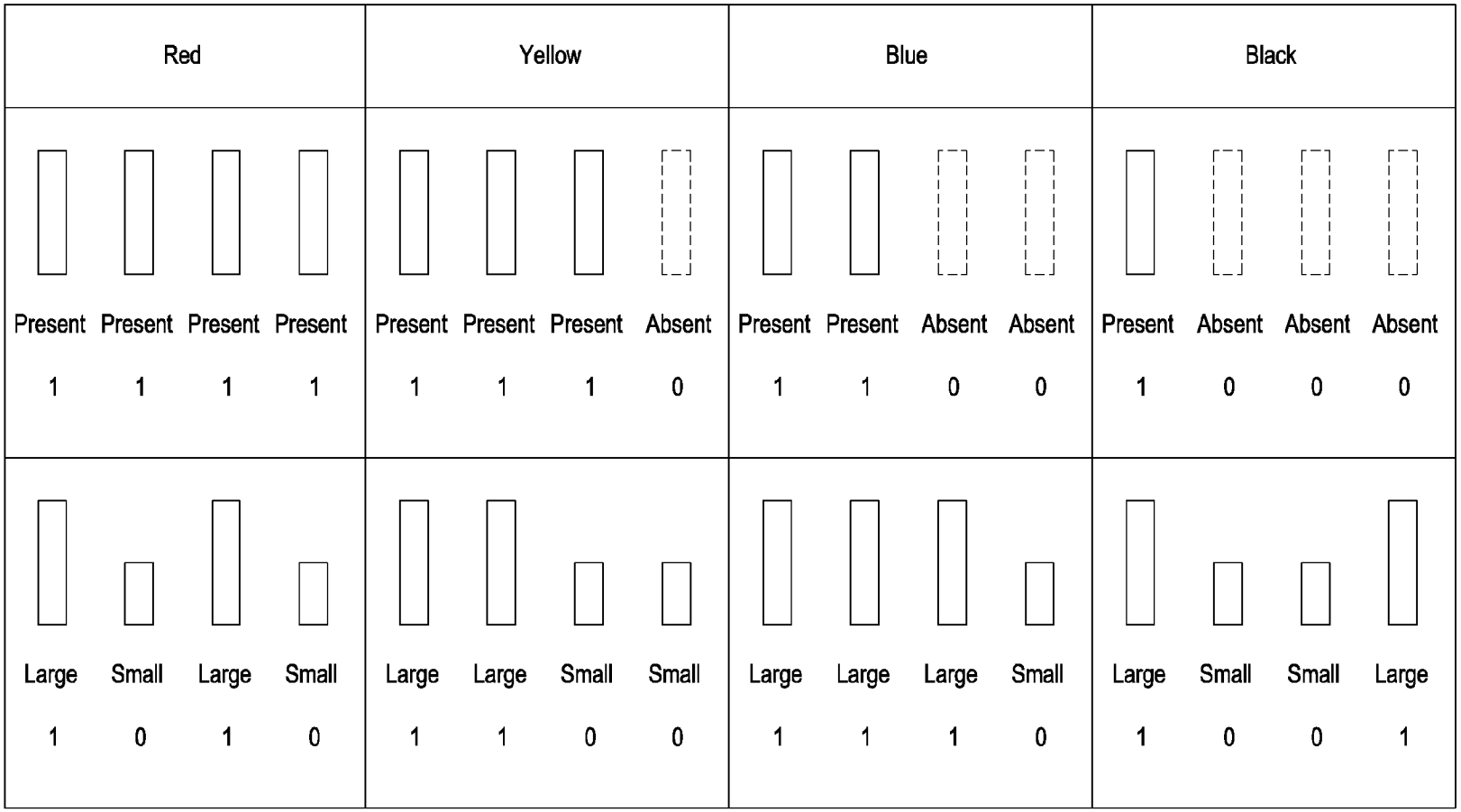
FIG. 11 is an explanatory view illustrating an arrangement pattern of the maximum of four detection electrodes and an arrangement pattern of four large and small detection electrodes.

FIG. 11 illustrates an arrangement pattern based on the presence or absence of up to four detection electrodes 40 (see upper portion in FIG. 11) and an arrangement pattern of four large and small detection electrodes 40 (see lower portion in FIG. 11). As illustrated in FIG. 11, four ink colors of "red", "yellow", "blue" and "black" are allocated to each of the arrangement patterns.

As described above, according to the second embodiment, the detection electrodes 40 ($\mathbf{40}_1$, $\mathbf{40}_2$, . . . , $\mathbf{40}_n$) used for tilt detection in the first embodiment can also be used for container identification. Therefore, it is possible to identify the liquid containers 20 without printing arrangement patterns (picture symbols) 50 on the liquid containers 20 or without forming individual projections 21*a* and 21*b* in the liquid containers 20, which contributes to cost reduction.

Third Embodiment (Built-in of Reference Capacitance for Calibration)

As described in the first embodiment, in the case of detecting the remaining amount of the liquid 29 such as ink or fuel, when the contents of the liquid 29 and the shape and size of the liquid container 20 containing the liquid 29 are predetermined, a remaining amount detection reference capacitance value (calculated value) for the container or contents may be prepared in advance to detect the remaining amount of the liquid by comparing the level of the liquid with the reference capacitance value. In this case, it is necessary to prepare a dedicated IC and a memory for storing the reference capacitance value and enabling it to be read out when necessary. However, if an IC or the like is prepared for each product (for example, for each liquid container), this may result in an increase in cost and time required for designing the product.

In order to avoid this, if a setting value of a factor is not predetermined, it is effective to set the factor in a later time. In this case, a setting value as a reference may be extracted under a state where the container is installed in a set such as a mounting unit for trial production and the like, and stored in a memory of an IC. As a specific example of a storage for the setting value, a built-in memory (for example, a flash memory) or an external memory (for example, an EEPROM) may be used. However, using an external memory or an IC having a built-in flash memory may incur additional costs.

Figure 12:
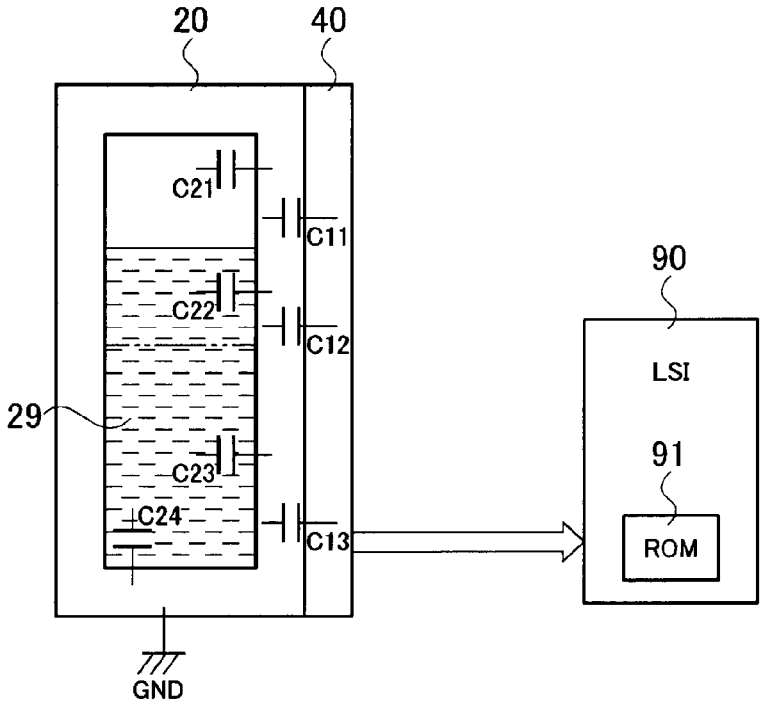
FIG. 12 is a schematic side view showing an example of a liquid container configured to store a detection reference capacitance value in a built-in memory (ROM) of an IC.
Figure 13:
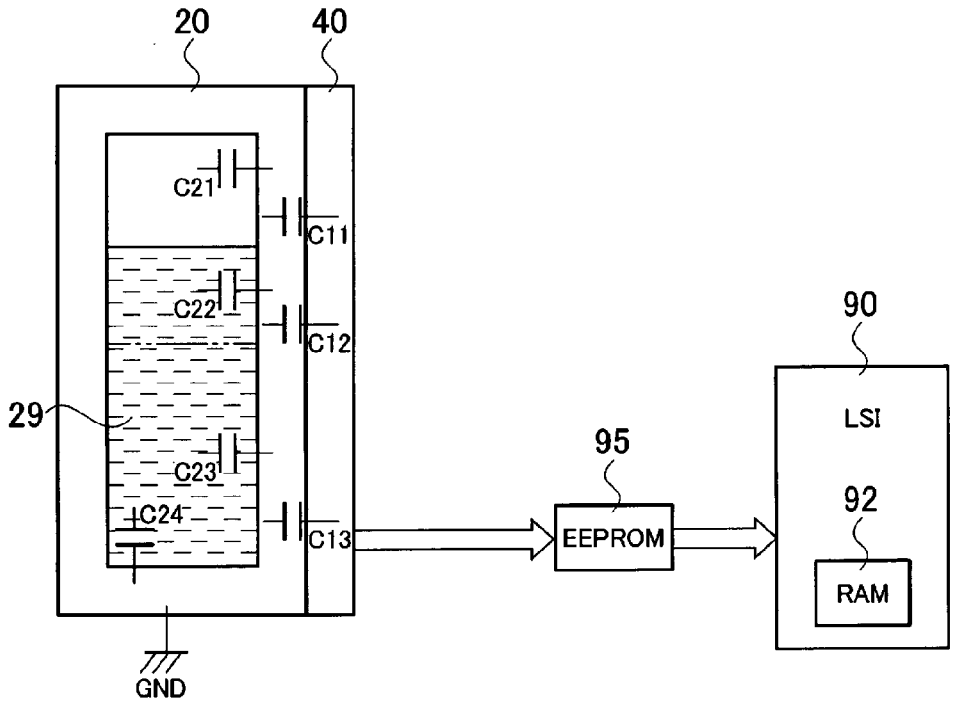
FIG. 13 is a schematic side view showing an example of a liquid container configured to store a detection reference capacitance value in an external memory and to read and store it in a built-in memory (RAM) of an IC when necessary.
Figure 14:
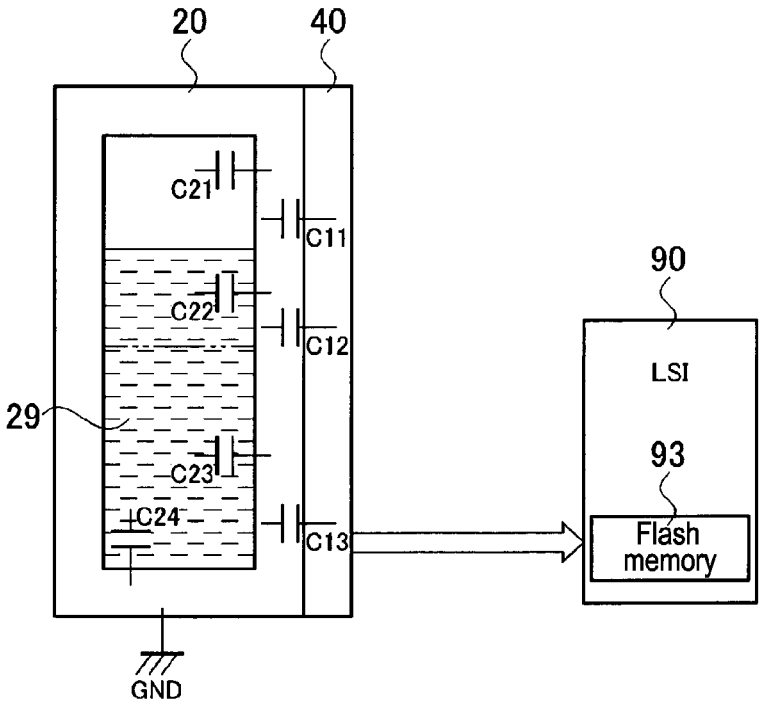
FIG. 14 is a schematic side view showing an example of a liquid container configured to store a detection reference capacitance value in a built-in memory (flash memory) of an IC.

FIG. 12 shows an example of a liquid container 20 configured to store a reference capacitance value in a built-in memory (ROM 91) of an IC 90. FIG. 13 shows an example of a liquid container 20 configured to store a reference capacitance value in an external memory (EEPROM 95) and read and store the same in a built-in memory (RAM 92) of an IC 90 when necessary. FIG. 14 shows an example of a liquid container 20 configured to store a reference capacitance value in an internal memory (flash memory 93) of an IC 90. In general, the ROM 91, the RAM 92, and the flash memory 93 establish a size relationship of ROM 91<RAM 92<flash memory 93.

In order to eliminate storage elements such as memories and achieve further cost reduction, a reference capacitance setting value is extracted by a calibration at a system start-up time and the like, and the extracted reference capacitance setting value is stored so as to be read out when necessary.

Figure 15:
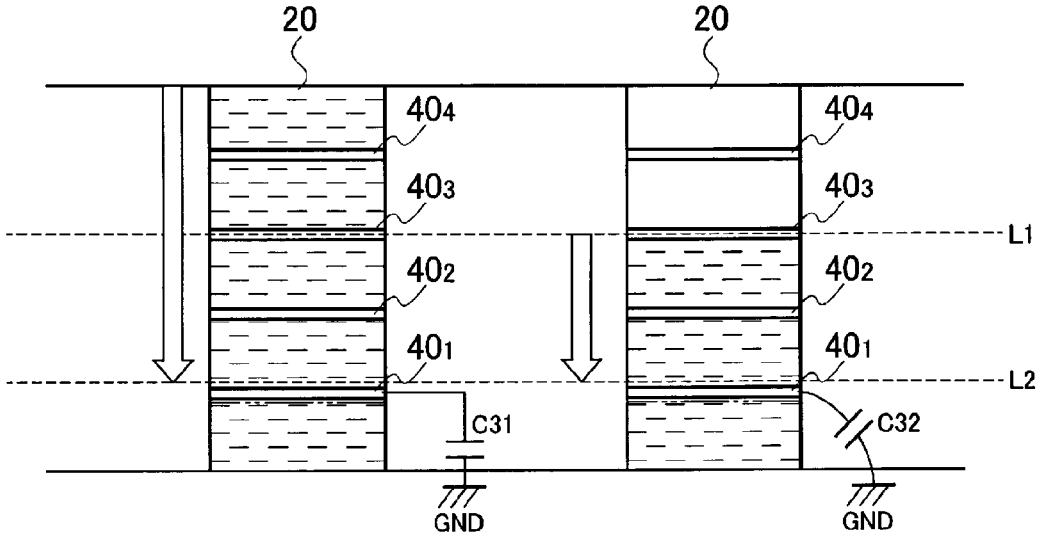
FIG. 15 is an explanatory view showing an example of setting of a detection reference capacitance value for a liquid container according to a third embodiment.

FIG. 15 schematically shows an example of a reference capacitance value set for the liquid container 20 according to the third embodiment.

In a configuration requiring a calibration, when detection is started under a state in which the liquid 29 fully fills a tank (the liquid 29 is the maximum amount) as illustrated in the left side of FIG. 15 or a state in which the current remaining amount of the liquid 29 is considered to fully fill a tank (the current remaining amount of the liquid 29 is considered to be the maximum amount), it is possible to carry out the calibration in the actual state. In some embodiments, a reference capacitance value C31 corresponding to a state (level L2) detected by the detection electrode $\mathbf{40}_1$ or a capacitance value close thereto may be stored as a reference value in an external memory or the like. In this case, the level of the liquid 29 is changed in a way of going down from a full state.

However, as illustrated in the right side of FIG. 15, in the case of restarting detection of the remaining amount of the liquid 29 in the middle of the process, i.e., in the case where it is necessary to recognize a previous state (a state before the restart, for example, the level L1) and restart detection, a structure such as a memory circuit for storing the previous state is required. In this case, a state in which the level of the liquid 29 in the liquid container 20 is lowered with respect to the full state (a previously detected capacitance value C32 which corresponds to the level L1 previously detected by the detection electrode $\mathbf{40}_3$) is stored and this information is inherited when restarting the detection (at a next power-on time).

In the third embodiment, the reference capacitance value C31 as described above is fixed and stored in advance (for example, at the time of factory shipment and the like), and the previously detected capacitance value C32 corresponding to the previously detected level L1 is stored at each time when the remaining amount detection process is performed (for example, when a power supply is turned off after detection) in the RAM 92, flash memory 93, and the like of the built-in IC 90. $W_1$th this configuration, the remaining amount detection, i.e., determining whether or not the level of the liquid 29 has fallen below the reference capacitance value, can be realized without using an external capacitor or a memory circuit. The reference capacitance value to be set for all environments where the value is commonly used is checked in advance and the minimum required capacitance value is stored as a reference value in the built-in IC 90. The storage of the reference capacitance value in the built-in IC 90 may be achieved by means of any methods including incorporation into an LSI, using an SiP (System in Package) which integrates an LSI and storage means of capacitances (the reference capacitance value C31 and the previously-detected capacitance value C32) in one IC package, writing digitized reference capacitance values into ROM, and the like.

Figure 16:
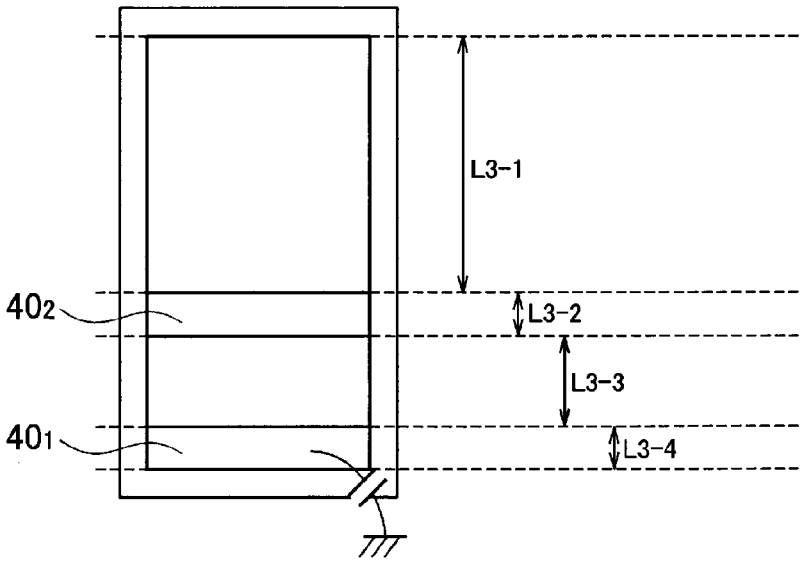
FIG. 16 is an explanatory view showing an example of detection of the liquid remaining amount using a detection reference capacitance value for the liquid container according to the third embodiment.

FIG. 16 schematically illustrates an example of detection of the remaining amount of the liquid 29 using a reference capacitance value for the liquid container 20 according to the third embodiment.

A reference capacitance value corresponding to the level in the vicinity of the detection electrodes $\mathbf{40}_1$ and $\mathbf{40}_2$ is embedded as a set reference in the IC 90. At the time of detection, a detected capacitance value is compared with the reference capacitance value to determine the status of the level of the liquid 29. When the detected capacitance value is equal to or smaller than the reference capacitance value, it may be determined that the level of the liquid 29 is lower than the positions of the detection electrodes $\mathbf{40}_1$ and $\mathbf{40}_2$.

In FIG. 16, when a calibration is performed on a level range L3-1, the same capacitance value is detected regardless of a change in the level until the level reaches the detection electrode $\mathbf{40}_2$. Thereafter, when a calibration is performed on a level range L3-2, a change in capacitance value in the width of the detection electrode $\mathbf{40}_2$ is detected. Further, when a calibration is performed on a level range L3-3, since a difference occurs between detection capacitance values in the detection electrode $\mathbf{40}_1$ and in the detection electrode $\mathbf{40}_2$, a fall of the liquid level below the detection electrode $\mathbf{40}_2$ can be detected. Here, the structure of the liquid container 20 is set such that the liquid level exists in the width of the lowest detection electrode $\mathbf{40}_1$.

As described above, according to the third embodiment, even in the case where the detection is temporarily stopped in the middle of the process and then is restarted, it is possible to detect the remaining amount of the liquid with high accuracy by comparing the liquid level with the reference capacitance value C31, without using a dedicated IC or a memory for storing the reference capacitance value C31 and enabling it to be read out when necessary.

(Application Example to Fuel Tank)

Figure 17:
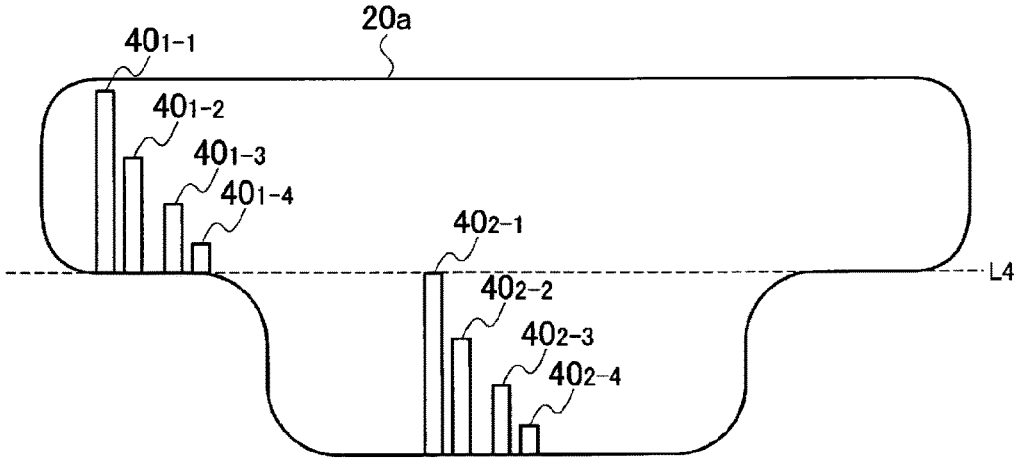
FIG. 17 is a schematic side view showing an example in which the liquid container according to the first and third embodiments is applied to a fuel tank of a car.

FIG. 17 schematically shows an application example of the liquid container 20 according to the embodiments to a fuel tank of a car or the like. A fuel tank of a car or the like has various shapes according to the body shape of the car. The fuel tank (liquid container 20) as illustrated in FIG. 17 includes detection electrodes $\mathbf{40}_{1\text{-}1}$, $\mathbf{40}_{1\text{-}2}$, $\mathbf{40}_{1\text{-}3}$ and $\mathbf{40}_{1\text{-}4}$ for detecting the remaining amount of the fuel (liquid) 29 within a range from a full level to a liquid level L4, and detection electrodes $\mathbf{40}_{2\text{-}1}$, $\mathbf{40}_{2\text{-}2}$, $\mathbf{40}_{2\text{-}3}$ and $\mathbf{40}_{2\text{-}4}$ for detecting the remaining amount of the fuel 29 within a range from the liquid level L4 to an empty level. Accordingly, it is possible to detect the remaining amount of the fuel 29 with high accuracy even in a case where the liquid container 20 has a distorted structure.

Figure 18A:
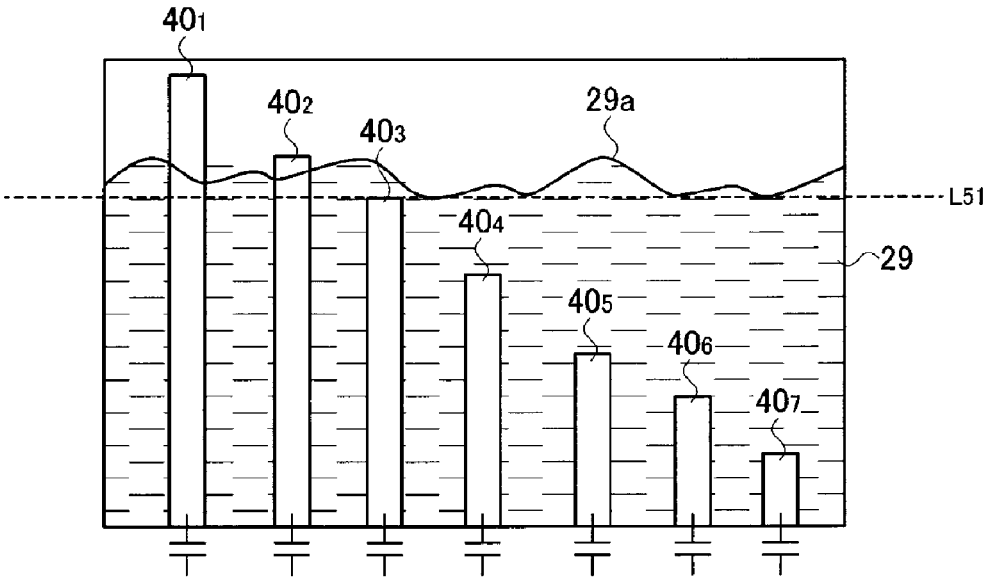
FIGS. 18A and 18B illustrate examples of detection of the liquid remaining amount in a state where a liquid surface in the liquid container according to the first and third embodiments is ruffled.
Figure 18B:
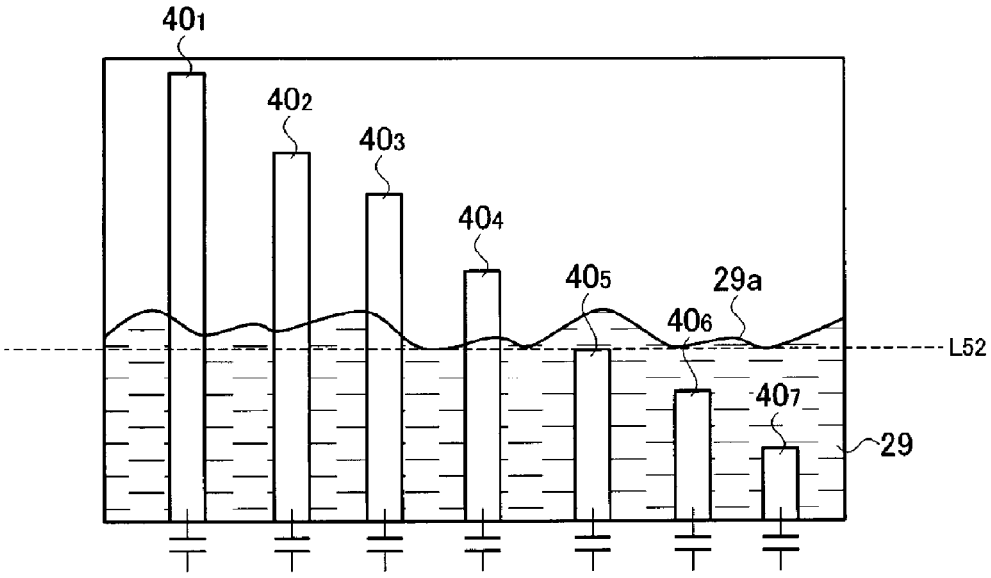

FIGS. 18A and 18B illustrate examples of detection of the liquid remaining amount in a state in which a liquid surface 29*a* in the liquid container 20 according to the embodiment is ruffled. Especially in the case of the fuel tank of the car, when the car is traveling, the liquid surface 29*a* of the fuel 29 is ruffled due to the vibration of the car. In addition, even when the car is stopped, since the parking place is not limited to a flat road surface, there are some cases where the liquid surface 29*a* is also not flattened. As illustrated in FIGS. 18A and 18B, since the liquid container 20 according to the embodiment includes a plurality of detection electrodes $\mathbf{40}_1$, $\mathbf{40}_2$, . . . , $\mathbf{40}_6$ and $\mathbf{40}_7$, it is possible to detect the liquid level L51 as shown in FIG. 18A by comparing detected capacitance values of the detection electrodes $\mathbf{40}_2$ and $\mathbf{40}_3$ and detect the liquid level L52 as shown in FIG. 18B by comparing detected capacitance values of the detection electrodes $\mathbf{40}_4$ and $\mathbf{40}_5$.

(Detection Circuit)

Figure 19:
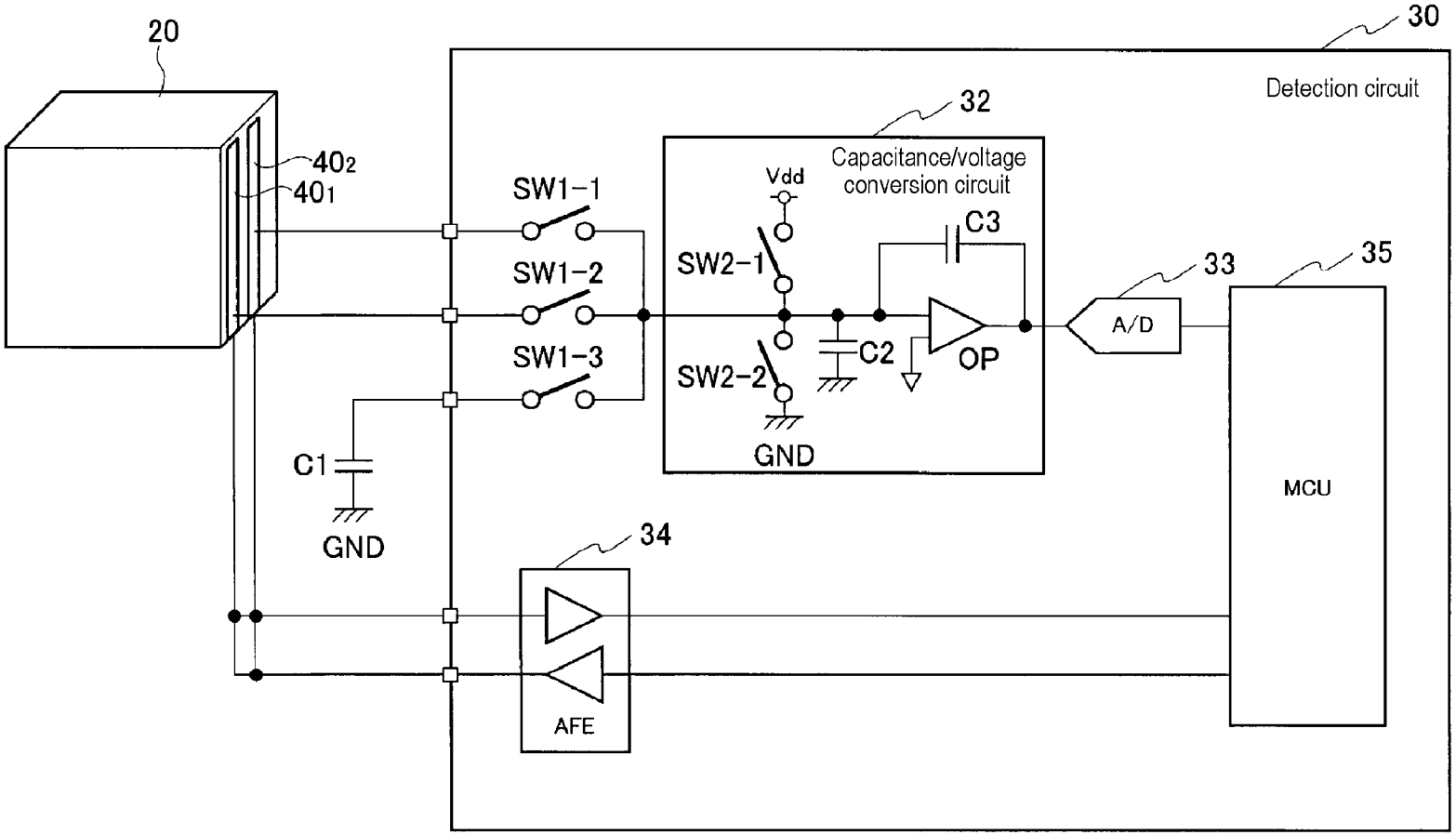
FIG. 19 is a schematic block diagram illustrating a block configuration of a detection circuit applicable to the first to third embodiments.

FIG. 19 is a schematic block configuration view of the detection circuit 30 applicable to the first to third embodiments. For the sake of simplicity of explanation, an example using two electrodes of the detection electrode $\mathbf{40}_1$ and the detection electrode $\mathbf{40}_2$ are shown in FIG. 19.

The detection circuit 30 includes: a switch group including a plurality of switches SW-1, SW-2, and SW-3, which selectively switches and connects one of the detection electrode $40_1$ and the detection electrode $40_2$ and a capacitor having a reference capacitance C1 to a capacitance/voltage conversion circuit 32; the capacitance/voltage conversion circuit 32 connected to the output side of the switch group; an analog/digital (AD) converter 33 connected to the output of the capacitance/voltage conversion circuit 32; an analog front end (AFE) 34 connected to the detection electrode $40_1$ and the detection electrode $40_2$; and a micro controller unit (MCU) 35 connected to the output of the A/D converter 33 and the output of the AFE 34. The capacitance/voltage conversion circuit 32 receives the capacitance C1 as the reference capacitance value and one of the detection electrode $40_1$ and the detection electrode $40_2$, which is selectively connected by the switch group, as measurement electrodes, and detects a displacement based on a comparison of a capacitance C2 of a capacitor connected to an inverting input of an operational amplifier OP and a capacitance C3 of a capacitor connected between the inverting input and an output of the operational amplifier OP. The output of the capacitance/voltage conversion circuit 32 is converted into a digital signal by the A/D converter 33, supplied to the MCU 35, and then detected as a value of the level (that is, the ink remaining amount) of the ink 29 in the liquid container 20.

The detection circuit 30 configured as above can function as the detection circuit 30 for detecting the remaining amount as described in the first embodiment and the third embodiment.

The AFE 34 connected to the detection electrode $40_1$ and the detection electrode $40_2$ detects the presence or absence (of the electrical connection) of the detection electrode $40_1$ and the detection electrode $40_2$ and supplies a result of the detection to the MCU 35. By detecting the presence or absence of the detection electrode $40_1$ and the detection electrode $40_2$, the detection circuit 30 can function, for example, as the detection circuit 30 for identifying the liquid container 20 as described in the second embodiment.

(Application Example to Print System)

(Print System (First Aspect))

Figure 20:
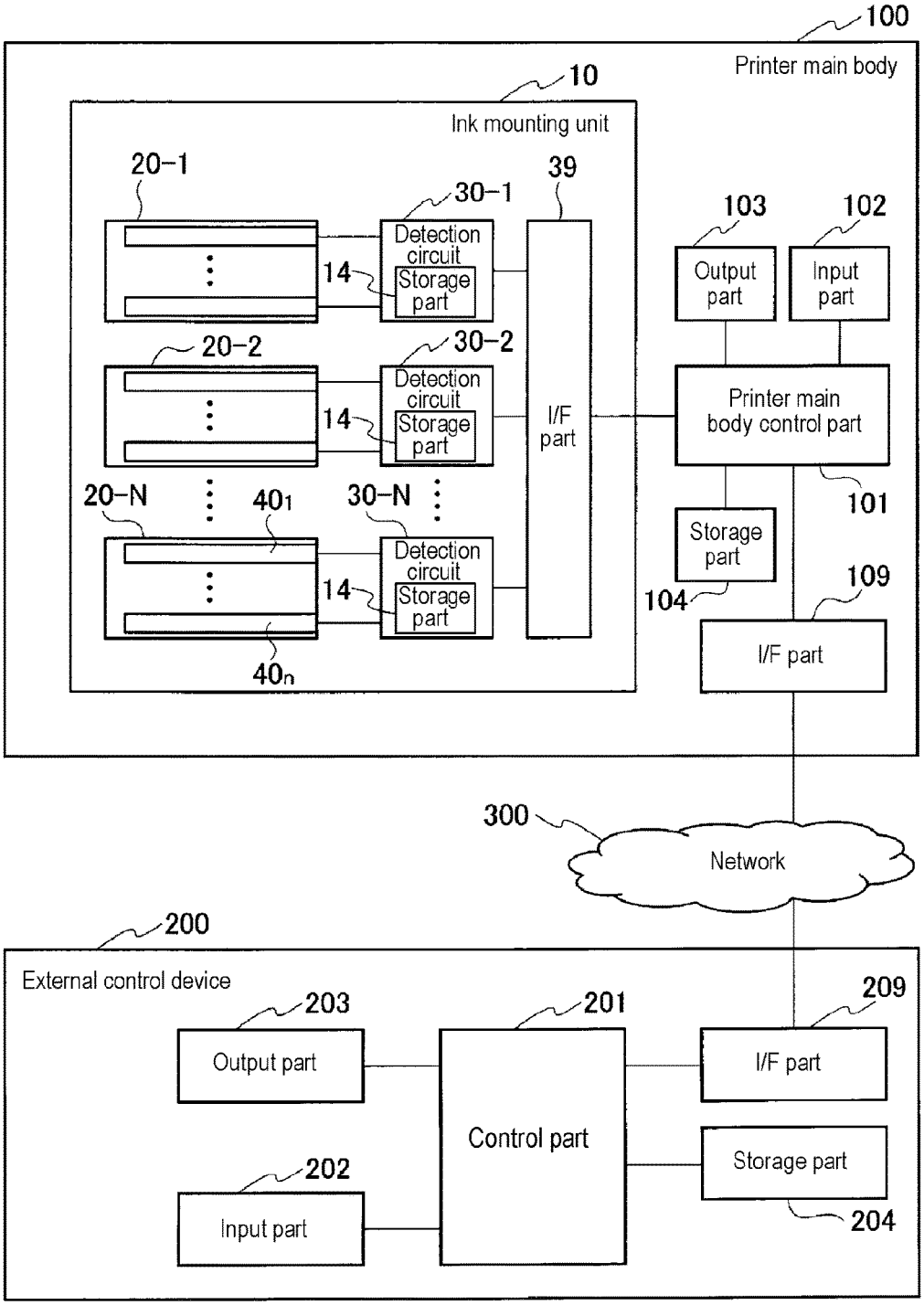
FIG. 20 is a schematic block diagram illustrating a first aspect of a print system applicable to the first to third embodiments.

FIG. 20 schematically illustrates a block configuration of a first aspect of a print system applicable to the first to third embodiments.

As illustrated in FIG. 20, the print system of the first aspect includes a printer main body 100 and an external control device 200 which are connected with each other directly or via a wired/wireless network 300 such as a cloud network.

The printer main body 100 includes an ink mounting unit 10, a printer main body control part 101, an input part 102, an output part 103, a storage part 104, and an I/F part 109.

The printer main body control part 101 transmits a setting value and a threshold value input from the input part 102 to the ink mounting unit 10 or stores them in the storage part 104. In addition, upon receiving ink shortage information or the like transmitted from the ink mounting unit 10, in response to the information, the printer main body control part 101 may output a warning message, a warning sound or the like to the output part 103 or notify the external control device 200 of the information via the L/F part 109.

The ink mounting unit 10 is configured to mount, for example, up to N (N is an integer equal to or greater than 1) ink cartridges (liquid containers) 20 (20-1, 20-2, . . . , 20-N). The ink mounting unit 10 includes N detection circuits 30 (30-1, 30-2, . . . , 30-N), each of which is connected to the detection electrodes $40_1$, . . . , $40_N$ of corresponding one of the N ink cartridges 20, and an I/F part 39 for controlling communication between each of the detection circuits 30 and the printer main body control part 101. The ink mounting unit 10 can appropriately mount the ink cartridges (liquid containers) 20 according to the first to third embodiments. Each of the detection circuits 30 (30-1, 30-2, . . . , 30-N) has an internal storage part 14 for storing a reference capacitance value for detection and a previous detected capacitance value. For example, the storage part 14 may be configured as an SiP (System in Package) that integrates an LSI and storage means for capacitances in one IC package.

In the print system according to the first aspect, since the detection circuits 30 are connected to the respective N ink cartridges 20 arranged for different ink colors, it is advantageous in terms of processing time over a detection operation of the plurality of ink cartridges 20 by using a single detection circuit 30.

The external control device 200 may be configured with, for example, a personal computer, a tablet computer, a smartphone, or the like. The external control device 200 includes a control part 201, an input part 202, an output part 203, a storage part 204, and an I/F part 209. The control part 201 transmits a setting value and a threshold value input from the input part 202 to the printer main body 100 or stores them in the storage part 204. In addition, upon receiving ink shortage information or identification information of the ink cartridges 20 transmitted from the printer main body 100, in response to the information, the control part 201 may output a warning message, a warning sound or the like to the output part 203.

(Print System (Second Aspect))

Figure 21:
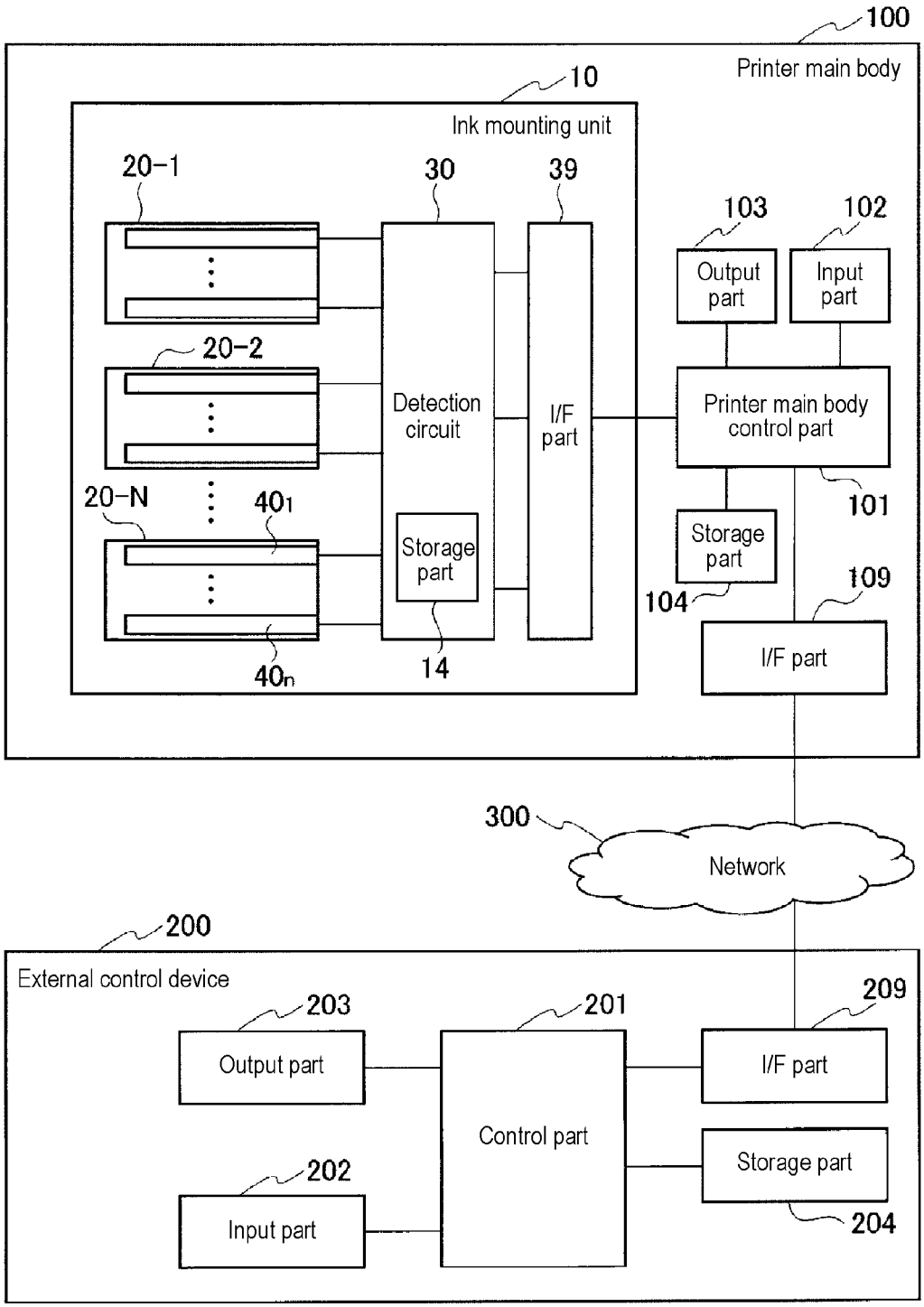
FIG. 21 is a schematic block diagram illustrating a second aspect of the print system applicable to the first to third embodiments.

FIG. 21 schematically illustrates a block configuration of a second aspect of the print system applicable to the first to third embodiments.

As illustrated in FIG. 21, in the print system according to the second aspect, the ink mounting unit 10 includes a single detection circuit 30 corresponding to the N ink cartridges 20-1, 20-2, . . . , 20-N, instead of the N detection circuits 30-1, 30-2, . . . , 30-N corresponding respectively to the N ink cartridges 20-1, 20-2, . . . , 20-N. The remaining parts have the same configurations as those in the print system according to the first aspect.

In the print system according to the second aspect, since the detection operation of the plurality of ink cartridges 20 is performed by the single detection circuit 30, it is possible to reduce the costs for the detection circuit 30.

(Print System (Third Aspect))

Figure 22:
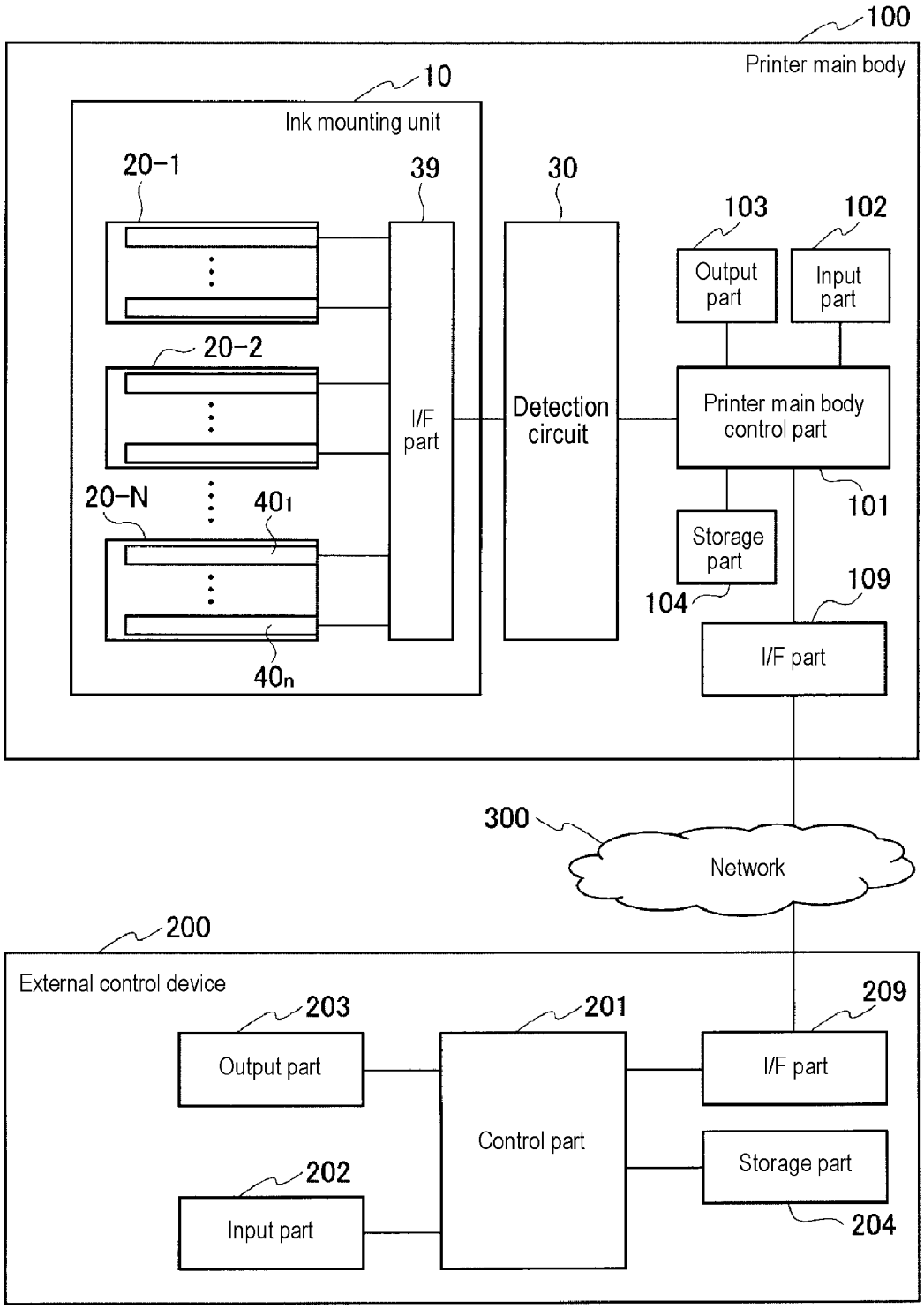
FIG. 22 is a schematic block diagram illustrating a third aspect of the print system applicable to the first to third embodiments.

FIG. 22 schematically illustrates a block configuration of a third aspect of the print system applicable to the first to third embodiments.

As illustrated in FIG. 22, in the print system according to the third aspect, instead of the ink mounting unit 10, the printer main body 100 includes a single detection circuit 30 corresponding to the N ink cartridges 20-1, 20-2, . . . , 20-N. The remaining parts have the same configurations as those in the print system according to the second aspect. Although not shown, the detection circuit 30 may include the storage part 14, separately from the storage part 104 included in the printer main body 100.

In the print system according to the third aspect, since the printer main body 100 includes the single detection circuit 30 that performs the detection operation of the plurality of ink cartridges 20, it is possible to reduce the costs for the ink mounting unit 10.

(Print System (Fourth Aspect))

Figure 23:
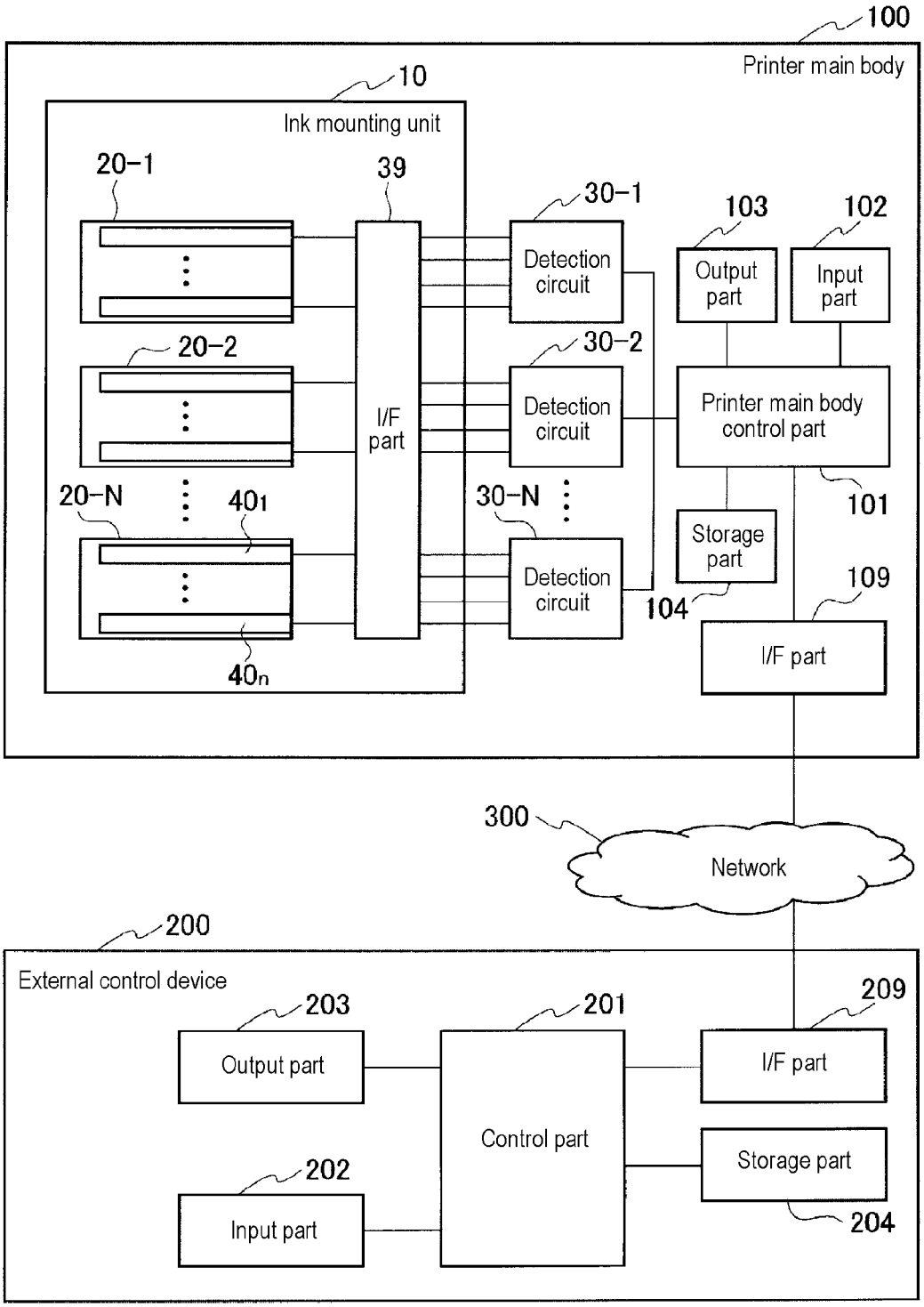
FIG. 23 is a schematic block diagram illustrating a fourth aspect of the print system applicable to the first to third embodiments.

FIG. 23 schematically illustrates a block configuration of a fourth aspect of the print system applicable to the first to third embodiments.

As illustrated in FIG. 23, in the print system according to the fourth aspect, instead of the ink mounting unit 10, the printer main body 100 includes the N detection circuits 30-1, 30-2, . . . , 30-N corresponding respectively to the N ink cartridges 20-1, 20-2, . . . , 20-N. The remaining parts have the same configurations as those in the print system according to the first aspect. Although not shown, each of the detection circuits 30-1, 30-2, . . . , 30-N may include the storage part 14, separately from the storage part 104 included in the printer main body 100.

In the print system according to the fourth aspect, since the printer main body 100 includes the N detection circuits 30-1, 30-2, . . . , 30-N that perform the respective detection operations of the plurality of ink cartridges 20, it is possible to reduce the costs for the ink mounting unit 10. In addition, it is more advantageous in terms of processing time than performing the detection operations of the plurality of ink cartridges 20 by using a single detection circuit 30.

(Print System (Fifth Aspect))

Figure 24:
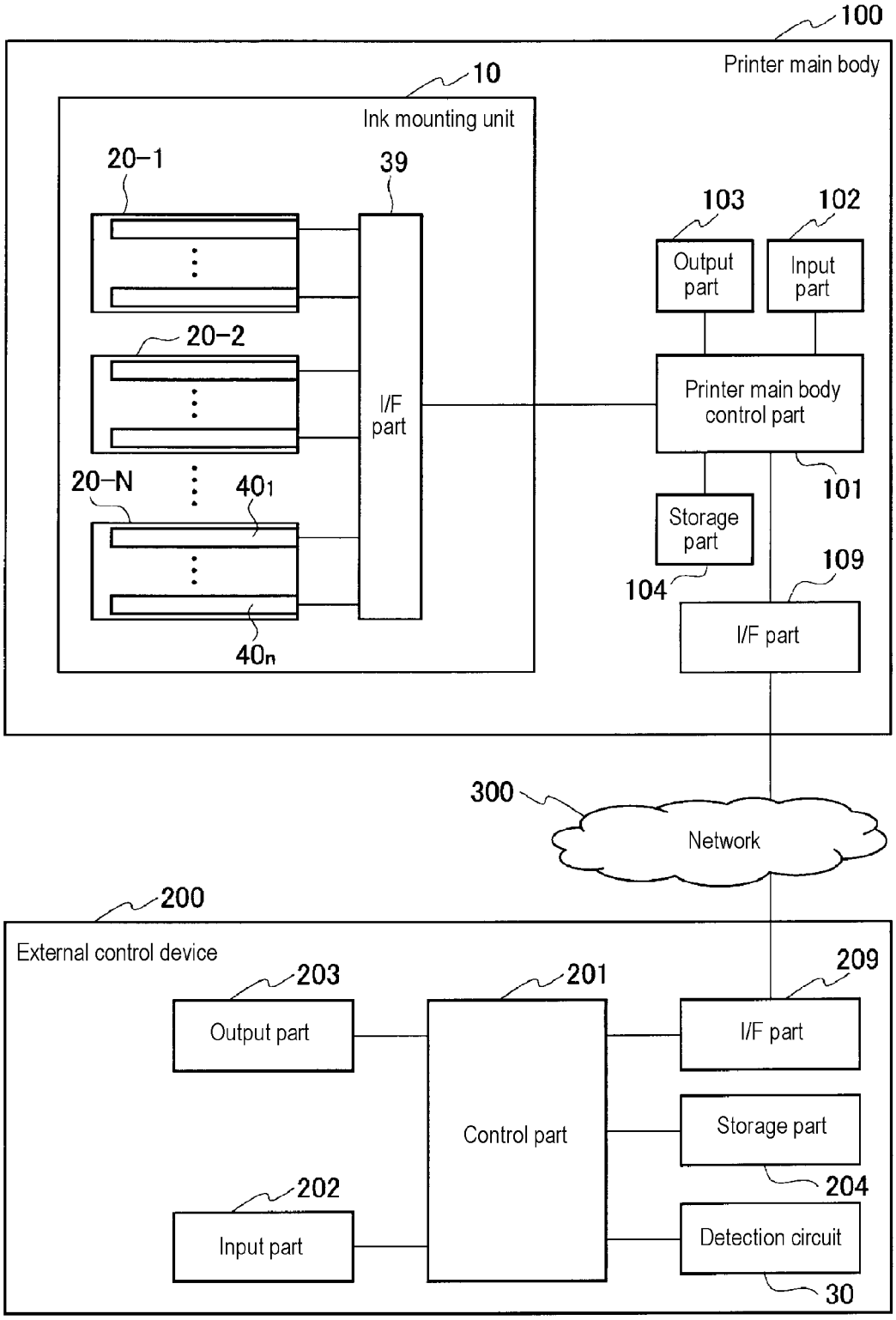
FIG. 24 is a schematic block diagram illustrating a fifth aspect of the print system applicable to the first to third embodiments.

FIG. 24 schematically illustrates a block configuration of a fifth aspect of the print system applicable to the first to third embodiments.

As illustrated in FIG. 24, in the print system according to the fifth aspect, instead of the ink mounting unit 10 and the printer main body 100, the external control device 200 includes the single detection circuit 30 corresponding to the N ink cartridges 20-1, 20-2, . . . , 20-N. The remaining parts have the same configurations as those in the print system according to the first to fourth aspects. Although not shown, the detection circuit 30 in the external control device 200 may include the storage part 14, separately from the storage part 204 included in the external control device 200.

In the print system according to the fifth aspect, since the external control device 200 includes the single detection circuit 30 that performs the detection operation of the plurality of ink cartridges 20, it is possible to reduce the costs for the ink mounting unit 10 and the printer main body 100.

(Method of Detecting Liquid Remaining Amount in Liquid Container According to First Embodiment)

Figure 25:
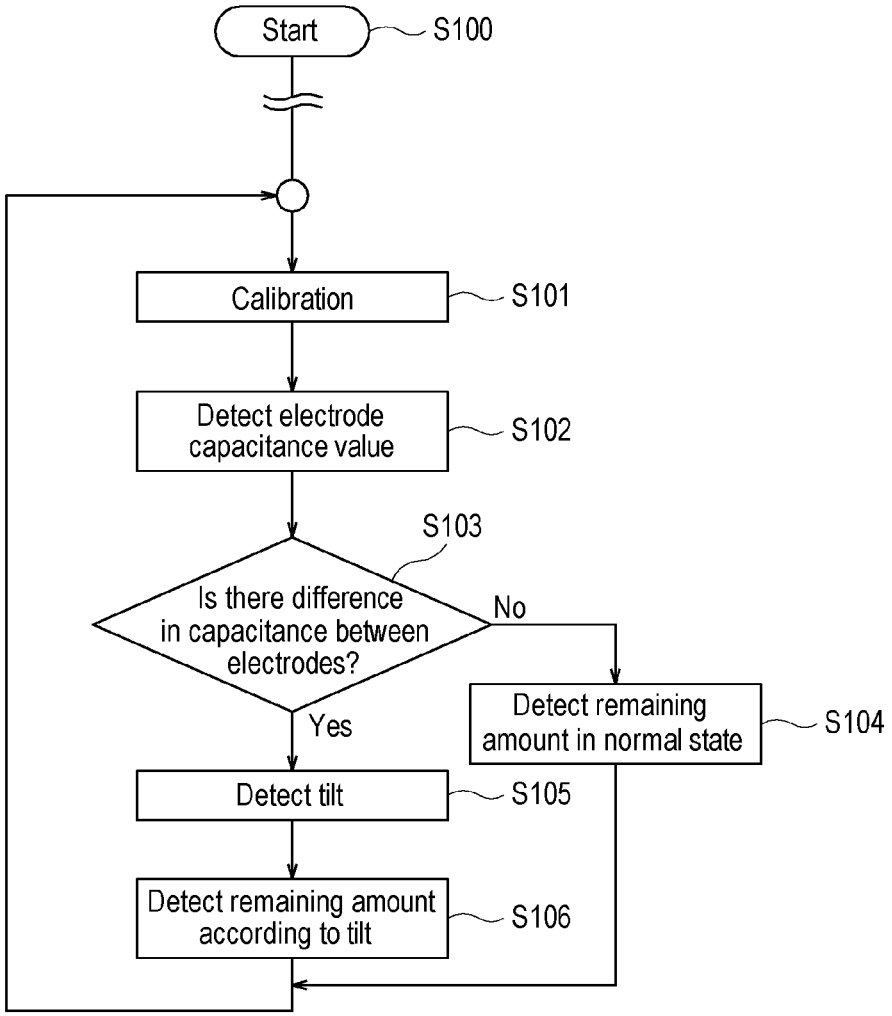
FIG. 25 is a flowchart schematically illustrating a process sequence of a detection method of a liquid remaining amount in the liquid container according to the first embodiment.

FIG. 25 schematically illustrates a process sequence of a method of detecting the liquid remaining amount in the liquid container 20 according to the first embodiment.

For example, when the printer main body 100 or the like is powered on (or the engine of a car is started), the process is started (step S100).

First, in step S101, a calibration is performed. Next, in step S102, the detection circuit 30 detects the liquid 29 in the liquid container 20 using the detection electrodes 40 ($\mathbf{40}_1$, $\mathbf{40}_2$, . . . , $\mathbf{40}_n$).

In step S103, the detection circuit 30 determines whether or not there is a difference in capacitance values of the detection electrodes 40 ($\mathbf{40}_1$, $\mathbf{40}_2$, . . . , $\mathbf{40}_n$) detected in the step S102.

When it is determined in the step S103 that there is no difference in capacitance values of the detection electrodes 40 ($\mathbf{40}_1$, $\mathbf{40}_2$, . . . , $\mathbf{40}_n$), the detection circuit 30 determines that the liquid container 20 is not tilted, and detects the remaining amount of the liquid 29 in a normal state (no-tilted state) (step S104).

When it is determined in the step S103 that there is a difference in capacitance values of the detection electrodes 40 ($\mathbf{40}_1$, $\mathbf{40}_2$, . . . , $\mathbf{40}_n$), the detection circuit 30 determines that the liquid container 20 is tilted, detects a tilt degree (angle and direction) of the liquid container 20 based on detected capacitance values (step S105), and detects the level (remaining amount) of the liquid 29 in response to the angle and direction of the tilt of the liquid container 20 (step S106).

When it is determined in the steps S104 and S106 that the liquid level is low, the detection circuit 30 may output a warning such as a warning message or a warning sound.

(Method of Identifying Liquid Container in Second Embodiment)

Figure 26:
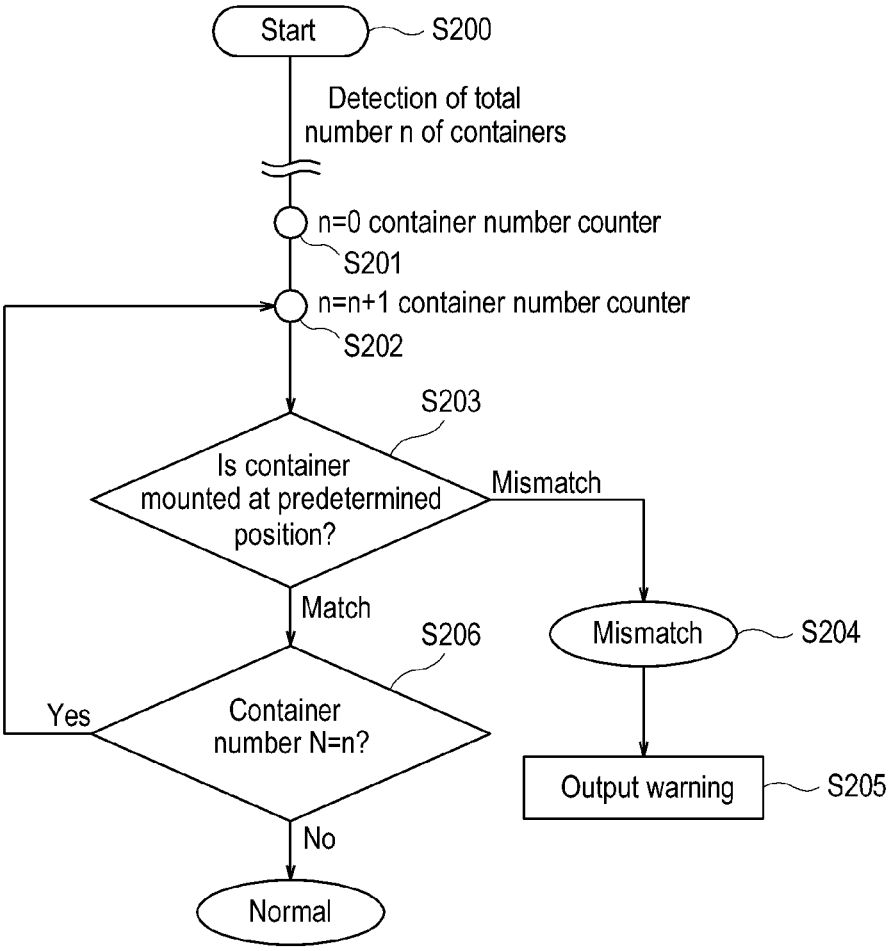
FIG. 26 is a flowchart schematically illustrating a process sequence of identifying the liquid container according to the second embodiment.

FIG. 26 schematically illustrates a process sequence for identifying the liquid container 20 according to the second embodiment.

For example, when the printer main body 100 or the like is powered on or an ink cartridge is replaced with a new one, the process is started (step S200). Thereafter, identification is performed for all the liquid containers 20 mounted on the mounting part such as the ink mounting unit 10.

First, in step S201, the detection circuit 30 initializes a number counter n of the liquid container 20 by setting the number counter n to be zero.

Next, in step S202, the detection circuit 30 increases the number counter n of the liquid container 20 by one and starts processing of the $n^{th}$ liquid container 20.

In step S203, based on the arrangement patterns of the detection electrodes 40 ($\mathbf{40}_1$, $\mathbf{40}_2$, . . . , $\mathbf{40}_n$) of the $n^{th}$ liquid container 20, the detection circuit 30 determines whether or not the $n^{th}$ liquid container 20 is mounted in a predetermined position.

When it is determined in the step S203 that the arrangement pattern of the $n^{th}$ liquid container 20 does not match a predetermined arrangement pattern, the detection circuit 30 determines that the $n^{th}$ liquid container 20 is not mounted in the predetermined position (step S204), and outputs a warning such as a warning message or a warning sound (step S205).

When it is determined in the step S203 that the arrangement pattern of the $n^{th}$ liquid container 20 matches the predetermined arrangement pattern, the detection circuit 30 determines that the $n^{th}$ liquid container 20 is correctly mounted in the predetermined position, and then determines whether or not the number counter n of the liquid container 20 has reached the number of liquid containers 20 (step S206).

When it is determined in the step S206 that the number counter n of the liquid container 20 has not reached the number of liquid containers 20, the detection circuit 30 returns to the step S202 to perform the identification process of the next liquid container 20.

When it is determined in the step S206 that the number counter n of the liquid container 20 has reached the number of liquid containers 20, the detection circuit 30 determines that all the liquid containers 20 are correctly mounted in the predetermined positions, and the process is ended (step S207).

(Method of Detecting Liquid Remaining Amount of Liquid Container According to Third Embodiment)

Figure 27:
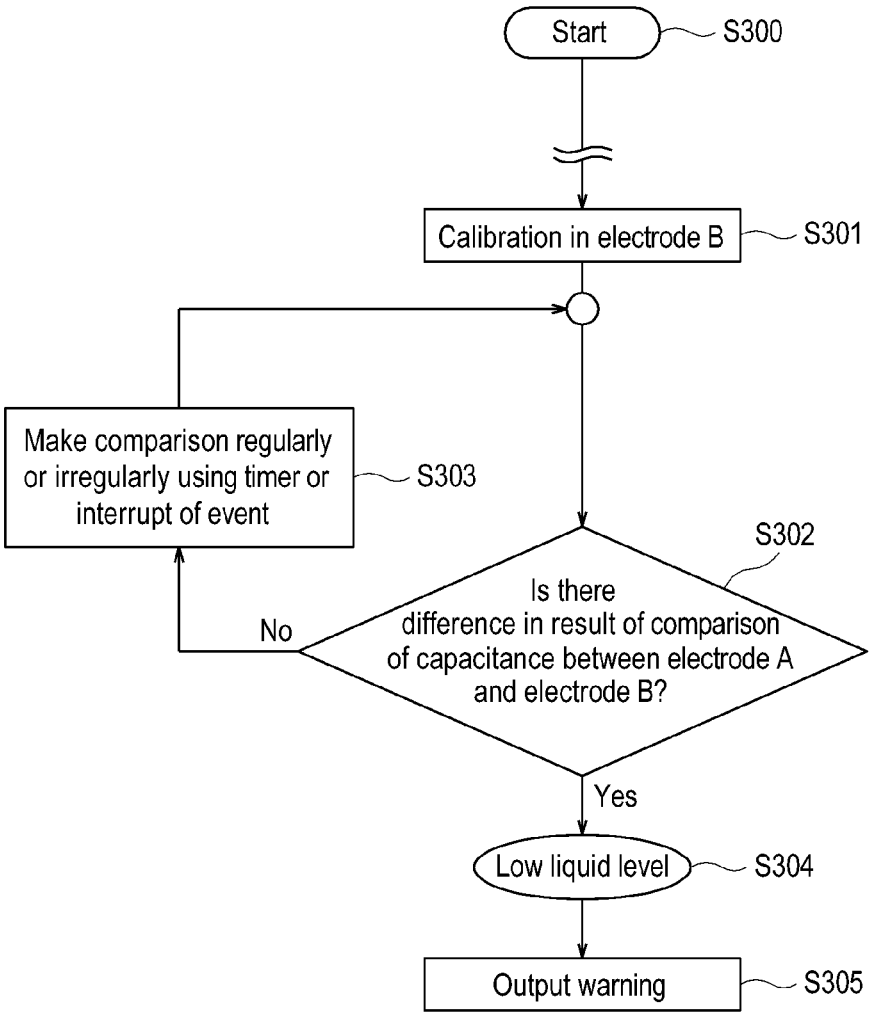
FIG. 27 is a flowchart schematically illustrating a process sequence of a detection method of a liquid remaining amount in the liquid container according to the third embodiment.

FIG. 27 schematically illustrates a process sequence of a method of detecting the liquid remaining amount in the liquid container 20 according to the third embodiment.

For example, when the printer main body 100 or the like is powered on (or the engine of a car is started), the process is started (step S300).

First, in step S301, the detection circuit 30 performs a calibration using the detection electrode $\mathbf{40}_2$, and sets and stores a reference capacitance value according to a state of the liquid container 20.

Next, in step S302, the detection circuit 30 detects the remaining amount of the liquid 29 while referring to the reference capacitance value and a previously detected capacitance value as necessary. The detection circuit 30 detects the remaining amount of the liquid 29 by determining whether or not there is a difference in capacitance values of the detection electrodes $\mathbf{40}_1$ and $\mathbf{40}_2$.

When it is determined in the step S302 that there is no difference in capacitance values of the detection electrodes $\mathbf{40}_1$ and $\mathbf{40}_2$, the detection circuit 30 determines that the liquid level is not yet low (not lower than the position of the detection electrode $\mathbf{40}_1$), and enters a standby state (step S303). Upon entering the standby state in the step S303, the detection circuit 30 detects the remaining amount of the liquid 29 regularly or irregularly, for example, using a timer (whether or not a predetermined period has elapsed) or an interrupt of an event (printing or the like) as a trigger.

When it is determined in the step S302 that there is a difference in capacitance values of the detection electrodes $\mathbf{40}_1$ and $\mathbf{40}_2$, the detection circuit 30 determines that the liquid level is low (lower than the position of the detection electrode $\mathbf{40}_1$) (step S304), and outputs a warning such as a warning message or a warning sound (step S305).

As described above, according to the first to third embodiments, it is possible to provide a liquid container, a liquid remaining amount detection circuit of the liquid container, a liquid remaining amount detection method, a liquid container identification method, an ink mounting unit, a printer, and a print system, which are capable of detecting the remaining amount of liquid such as ink with high precision with a simple and inexpensive mechanism and identifying a liquid container such as an ink cartridge with a simple and inexpensive mechanism.

OTHER EMBODIMENTS

As described above, although the first to third embodiments of the present disclosure has been illustrated, the description and drawings which constitute a part of this disclosure are presented by way of example only and should not be construed to limit the present disclosure. Various alternative embodiments, examples and operation techniques will be apparent to those skilled in the art from this disclosure.

For example, in the first to third embodiments, the ink for a printer and the fuel for a car have been described. However, the present disclosure can be equally applied to detection of a remaining amount of other fluids that can be detected by a capacitance method or a pressure-sensitive resistive film method.

Thus, the present disclosure encompasses various embodiments not described here.

The first to third embodiments are applicable to various application fields including a printer, a copying machine, a multifunction peripheral, a fuel cell of a car, a cash register at a retail store, a ticket machine at a restaurant, a ticket vending machine at a station or an airport, etc.

According to the present disclosure in some embodiments, it is possible to provide a liquid container, a liquid remaining amount detection circuit of the liquid container, a liquid remaining amount detection method, a liquid container identification method, an ink mounting unit, a printer, and a print system, which are capable of detecting the remaining amount of liquid such as ink with high precision with a simple and inexpensive mechanism and identifying a liquid container such as an ink cartridge with a simple and inexpensive mechanism.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A detection circuit connected to a plurality of detection electrodes mounted on a liquid container, comprising:

a capacitor having a reference capacitance;

a capacitance/voltage conversion circuit configured to determine a voltage value corresponding to a level of a liquid in the liquid container by comparing capacitances detected by the plurality of detection electrodes with the reference capacitance;

an analog/digital converter connected to an output of the capacitance/voltage conversion circuit, and configured to convert the voltage value into a digital signal; and a microcontroller unit connected to an output of the analog/digital converter, and configured to receive the digital signal as a value of the level of the liquid, wherein the detection circuit detects a degree of tilt of the liquid container based on the capacitances detected by the plurality of detection electrodes, and detects a remaining amount of the liquid in the liquid container according to the detected degree of tilt, wherein the plurality of detection electrodes is installed with a predetermined distance from the liquid so as to prevent the plurality of detection electrodes from making direct contact with the liquid, wherein the plurality of detection electrodes extends along an outer wall of the liquid container and parallel with the outer wall, and wherein the plurality of detection electrodes is arranged on the outer wall such that at least a portion of each of the plurality of detection electrodes is exposed to an outside of the liquid container.

2. The detection circuit of claim 1, wherein the degree of tilt of the liquid container includes an angle of tilt and a direction of tilt.

3. The detection circuit of claim 1, further comprising:

a storage part configured to store capacitances previously detected by the plurality of detection electrodes, wherein the detection circuit determines the level of the liquid based on the previously detected capacitances.

4. The detection circuit of claim 3, wherein the reference capacitance is preset and stored in advance in the storage part.

5. The detection circuit of claim 3, wherein the detection circuit is integrated in one integrated circuit package.

6. The detection circuit of claim 1, wherein the detection circuit identifies the liquid container based on an arrangement pattern of the plurality of detection electrodes.

7. The detection circuit of claim 6, wherein the arrangement pattern is identified based on a presence or absence of the plurality of detection electrodes at predetermined locations of the liquid container.

8. The detection circuit of claim 7, further comprising:

an analog front end connected to the plurality of detection electrodes, and configured to detect the presence or absence of the plurality of detection electrodes at the predetermined locations and supply a detection result to the microcontroller unit.

9. The detection circuit of claim 6, wherein the arrangement pattern is identified based on a size of the plurality of detection electrodes.

* * * * *